US008844424B2

(12) United States Patent
Gomez

(10) Patent No.: US 8,844,424 B2
(45) Date of Patent: Sep. 30, 2014

(54) BOLT CARRIER AND BOLT FOR GAS OPERATED FIREARMS

(71) Applicant: LWRC International, LLC, Cambridge, MD (US)

(72) Inventor: Jesus S. Gomez, Trappe, MD (US)

(73) Assignee: LWRC International LLC, Cambridge, MD (US)

( * ) Notice: Subject to any disclaimer, the term of this patent is extended or adjusted under 35 U.S.C. 154(b) by 12 days.

(21) Appl. No.: 13/841,618

(22) Filed: Mar. 15, 2013

(65) Prior Publication Data

US 2014/0090283 A1 Apr. 3, 2014

Related U.S. Application Data

(63) Continuation-in-part of application No. 13/588,294, filed on Aug. 17, 2012.

(60) Provisional application No. 61/524,500, filed on Aug. 17, 2011.

(51) Int. Cl.
*F41A 15/12* (2006.01)

(52) U.S. Cl.
CPC ..... *F41A 15/12* (2013.01)
USPC ..... 89/132; 89/137; 89/33.01; 89/191.01; 42/16; 42/25

(58) Field of Classification Search
USPC ..... 89/132, 137–138, 33.01, 191.01; 42/16, 42/25
See application file for complete search history.

(56) References Cited

U.S. PATENT DOCUMENTS

| | | | | |
|---|---|---|---|---|
| 3,027,672 | A | 4/1962 | Sullivan | |
| 7,316,091 | B1 | 1/2008 | Desomma | |
| 7,735,410 | B2 | 6/2010 | Clark | |
| 7,784,211 | B1 | 8/2010 | Desomma | |
| 7,930,968 | B2 | 4/2011 | Giefing | |
| 8,387,513 | B2 * | 3/2013 | Gomez et al. | 89/191.01 |
| 2008/0092733 | A1 | 4/2008 | Leitner-Wise et al. | |
| 2010/0122483 | A1 * | 5/2010 | Clark | 42/69.02 |
| 2012/0152105 | A1 * | 6/2012 | Gomez et al. | 89/191.01 |
| 2012/0180354 | A1 * | 7/2012 | Sullivan et al. | 42/16 |
| 2014/0026744 | A1 * | 1/2014 | Gomez et al. | 89/191.01 |
| 2014/0075817 | A1 * | 3/2014 | Gomez | 42/75.02 |
| 2014/0076144 | A1 * | 3/2014 | Gomez | 89/132 |
| 2014/0076146 | A1 * | 3/2014 | Gomez | 89/191.01 |

* cited by examiner

*Primary Examiner* — Michael David
(74) *Attorney, Agent, or Firm* — Squire Patton Boggs (US) LLP

(57) ABSTRACT

An improved bolt and bolt carrier with integral gas key having an extension nozzle threadedly secured and pinned to the gas key for use with a direct gas operated firearm is provided. The extension nozzle is designed to receive a portion of the host firearms gas operating system. The firing pin retaining pin is oriented so as to expose its widest profile to the firing pins annular flange, increasing its service life. The bolt has a plurality of lugs extending from its forward end and an extractor recess. The extractor recess is constructed to accommodate an enlarged extractor claw while not undercutting the bolt lugs adjacent thereto. The extractor engages approximately 57% more of a seated ammunition cartridges rim as compared to some prior art AR15/M16 type extractors used with automatic firearms chambered in 6.8 SPC. The result is an improved bolt and bolt carrier which provides for increased operational reliability.

16 Claims, 29 Drawing Sheets

(PRIOR ART)
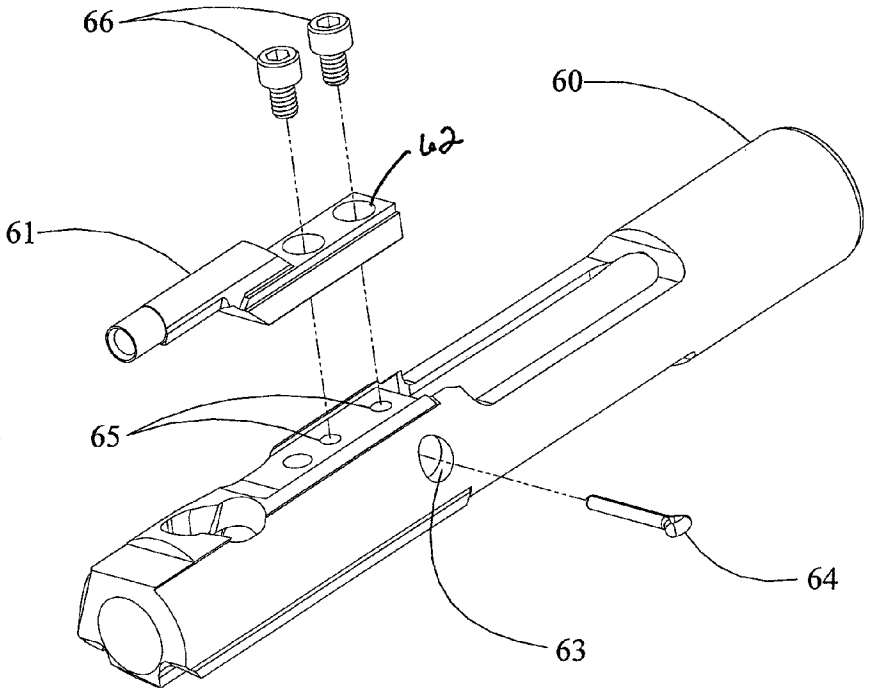
FIG. A

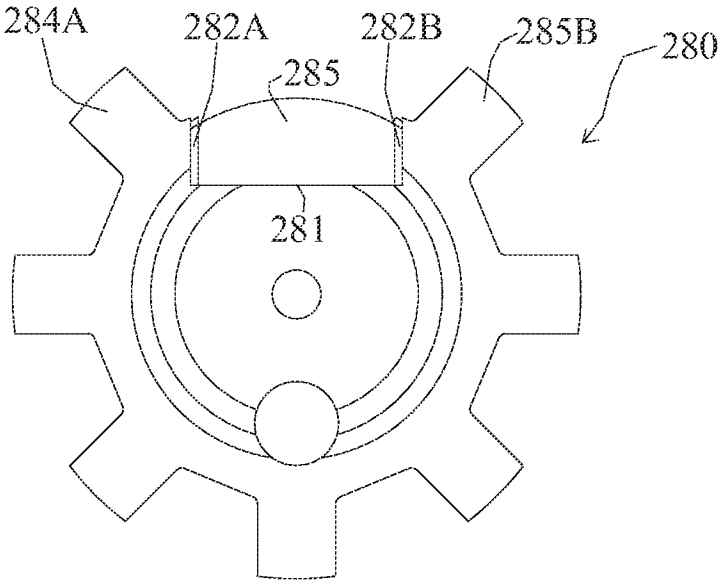
FIG. B

BOLT CARRIER AND BOLT FOR GAS OPERATED FIREARMS

This is a continuation-in-part application claiming benefit of U.S. application Ser. No. 13/588,294, filed Aug. 17, 2012, which claims priority under 35 U.S.C. 119(e) to U.S. provisional Ser. No. 61/524,500, filed Aug. 17, 2011, each of which is herein incorporated by reference in its entirety.

BACKGROUND OF THE INVENTION

1. Field of the Invention

The present invention relates to gas-operated firearms and, more particularly, to an improved bolt and bolt carrier for use in such firearms.

2. Description of the Related Art

The AR15/M16 family of firearms and their derivatives, including all direct gas operated versions, have been in use by the military and civilian population for many years. An essential part of this firearm's design is the bolt carrier which typically includes a bolt mounted in the carrier for axial sliding movement and rotation, a firing pin slidably mounted within the bolt and bolt carrier for restricted reciprocating axial movement, and a cam pin for limiting relative rotation between the bolt and the bolt carrier.

The bolt carrier is generally cylindrical in shape with a longitudinally extending circular bore throughout its length. An elongated opening is provided in the top and bottom of the carrier to allow the hammer to extend into the interior of the bolt carrier and strike the firing pin. The carrier is received and housed within the firearms receiver with the front of the carrier housing the bolt. The upper surface of the carrier immediately adjacent the front face includes a flat shelf for engagement with a charging handle. About the exterior of the bolt carrier are a series of lands and accompanying grooves, usually four, which extend from the forward end of the bolt carrier rearwardly over a distance of about one half the length of the bolt carrier. There are openings on the bolt carrier to mount a gas key, an opening which serves as a gas receiving port and an opening to receive the cam pin. Typically the gas key is secured to the bolt carrier through the use of two screws while the firing pin is retained in place through the use of a retaining or cotter pin.

Like the bolt carrier, the bolt has a body that is generally cylindrical in shape and is provided with a circular bore throughout its length which is designed to accommodate a firing pin. Located radially about a forward portion of the bolt are a series of lugs and an extractor. The exterior of the bolt has a recess provided therein with an extractor bearing surface that houses the extractor. The forward end of the extractor includes a gripping element, or claw, which catches and holds onto the rim of the case head of an ammunition cartridge.

The extractor rotates about a pin received by both the bolt body and the extractor. Located at the rearward end of the extractor is a spring and internal buffer. The extractor spring and buffer press against the extractor bearing surface thereby resisting rotation of the extractor about its axis and facilitate the extraction of a used ammunition cartridge.

Present on the front face of the bolt is an ejector that is located opposite the side of the front face adjacent the extractor. The ejector consists of a spring-loaded pin which is retained in place on the bolt through the use of a roll pin. The ejector assists in pushing an ammunition cartridge away from the bolt face when the firearm is being fired or otherwise unloaded.

The bolt carrier group is responsible for stripping, chambering, locking, firing, extraction and ejection of ammunition cartridges for the host rifle. The energy to perform these functions is provided in the form of hot, expanding gases which travel through the host firearm's gas tube, through the gas key and into the bolt carrier. A secure union between the gas key and bolt carrier is important to the proper operation of a direct gas operated firearm. Should the gas key become loose or be removed, the associated firearm will not properly function due to resulting gas leakage.

As shown in FIG. A, the prior art method of attaching a gas key to the bolt carrier relies on two screws which are torqued and then staked in place.

FIG. A illustrates a prior art bolt carrier 60 which uses a separate gas key 61 that has an integral nozzle for communicating with the gas tube of the host rifle. The base of the gas key 61 is secured to the bolt carrier 60 through the use of two retention screws 66. The retention screws are inserted through the openings 62 located on the base of the gas key 61 then threaded into the openings 65 located on the top surface of the bolt carrier 60. This method is deficient as the max torque applied to the screws is not sufficient to prevent the screws 66 from becoming threadedly unsecured due to vibration and the heating/cooling cycle of the host rifle during normal operation. The result is gas leakage which decreases the reliability of the host rifle by causing extraction and feeding related malfunctions.

The retaining pin or cotter pin 64 found in the prior art is retained within an opening 63 that provides no method to orient the pin 64. As a result the pin 64 can be placed either by the user, or through rotation occurring during normal use of the rifle, into a position which orients the thinnest profile of the cotter pin towards the firing pin. This deficiency in the prior art reduces the service life of the cotter pin 64 resulting in several critical issues. The cotter pin can become bent such that maintaining the rifle is difficult since the cotter pin should be removed to service the bolt and bolt carrier properly. Removing a bent cotter pin 64 through the provided opening 63 is difficult, often requiring tools such as pliers to accomplish. Once the cotter pin 64 is removed, the user must be able to reinsert the cotter pin 64 back into the opening 63 of the bolt carrier 60. If the cotter pin 64 is bent, this operation is often virtually impossible. The cotter pin 64 can also break or bend sufficiently thereby rendering the rifle inoperable. The terms "cotter pin" and "retaining pin" are used interchangeably herein.

The prior art bolt has several points of deficiency. First, there are seven bolt lugs placed radially about the forward end of the bolt. These lugs are evenly spaced apart except for the gap created on the exterior of the bolt to accommodate the extractor, which gap is referred to herein as the extractor pocket. When the extractor pocket is machined, a portion of the bolt's face is removed, resulting in the case head of the cartridge not being fully supported (see FIG. B).

Second, the lugs located on either side of the extractor pocket are not fully supported, rendering them the weakest lugs on the prior art bolt. As such, these two lugs experience the highest rate of failure. Further, the lugs themselves are machined with sharp edges or geometric corners about their exterior. These geometric corners often accumulate material stress which can result in micro fractures that limit the service life of the bolt.

Third, extraction of a spent cartridge by the extractor, extractor spring and buffer can be disrupted due to a variety of conditions including a fouled barrel chamber, an over pressured gas system, an improperly annealed cartridge rim, as well as others. To compensate for this deficiency, various remedies have been developed to include, for example, the use of o-rings which increase the force the extractor is capable of placing on the rim of an ammunition cartridge.

Fourth and fifth, problems persist with the present method of securing the gas key to the bolt carrier using two screws as described above, and with the method by which the cotter pin that retains the firing pin is able to rotate into a structurally weak position. Finally, there is a deficiency in prior art methods of manufacturing the bolt. It would be highly advantageous, therefore, to remedy the foregoing and other deficiencies inherent in the prior art.

SUMMARY OF THE INVENTION

In view of the foregoing, one object of the present invention is to overcome the shortcomings in the design of bolt carriers and bolts for self-loading firearms as described above.

Another object of the present invention is to provide a bolt carrier having an integral gas key with a removable nozzle which is constructed to be in communication with a gas tube of the host firearm.

Yet another object of the present invention is to provide a bolt carrier in accordance with the preceding objects in which the nozzle is threadedly secured to the gas key and held in place with a cross pin that relies on tension and the structure of the upper receiver to retain the cross pin in place.

A further object of the present invention is to provide a bolt carrier in accordance with the preceding objects in which the bolt carrier is constructed to orient the cotter pin that retains the firing pin such that the widest profile of the cotter pin is always oriented towards the firing pin.

A still further object of the present invention is to provide a bolt and bolt carrier in accordance with the preceding objects which includes a bolt with fully supported bolt lugs and an improved structure for incorporation of the extractor.

Another object of the present invention is to provide a bolt in accordance with the preceding objects in which the extractor engages a larger portion of the rim of the cartridge case as compared to prior art extractors.

A still further object of the present invention to provide an improved bolt carrier in accordance with the preceding objects that is not complex in structure and which can be manufactured at low cost but yet increases the reliability and safety of the firearm.

In accordance with these and other objects, the present invention is directed to a direct gas operated firearm of the AR15/M16 variety having an improved bolt carrier assembly. This improved bolt carrier assembly can be retrofitted to an existing direct gas operated AR15/M16 type rifle without the need for any modification to the receiver of the rifle or any other part thereof.

The improved bolt carrier includes an integral gas key which is threaded to receive an extension nozzle which is constructed to receive a portion of the host firearm's gas tube. The extension nozzle is held in place through the use of a cross pin which prevents loosening of the nozzle during use of the firearm.

The present invention also provides an improved bolt carrier that includes a machined structure on the exterior of the bolt carrier which optimally orients the cotter pin that retains the firing pin so as to maximize the service life of the cotter pin. In particular, the retaining pin is oriented in a vertical profile so that the widest profile of the retaining pin is always oriented toward the firing pin.

In addition, the improved bolt carrier according to one embodiment of the present invention has a bolt with a fully supported bolt face, eliminating the machining of a gap into the bolt face in order to accommodate an extractor. By fully supporting the bolt face, the lugs located on either side of the extractor pocket are not undercut, resulting in a more durable bolt.

Still further, one embodiment of the bolt includes an extractor having an extractor claw that grabs or engages approximately 17% more of an ammunition cartridge's rim as compared with prior art extractors. By spreading the forces related to extraction over a larger area of the rim of the cartridge, the likelihood of failed extraction is substantially diminished.

These together with other improvements and advantages which will become subsequently apparent reside in the details of construction and operation as more fully hereinafter described and claimed, reference being made to the accompanying drawings forming a part hereof, wherein like numerals refer to like parts throughout.

BRIEF DESCRIPTION OF THE DRAWINGS

FIG. A is a side perspective view of a prior art bolt carrier and gas key.

FIG. B is a top view of a prior art bolt face.

DETAILED DESCRIPTION OF THE PREFERRED EMBODIMENTS

Figure 1:
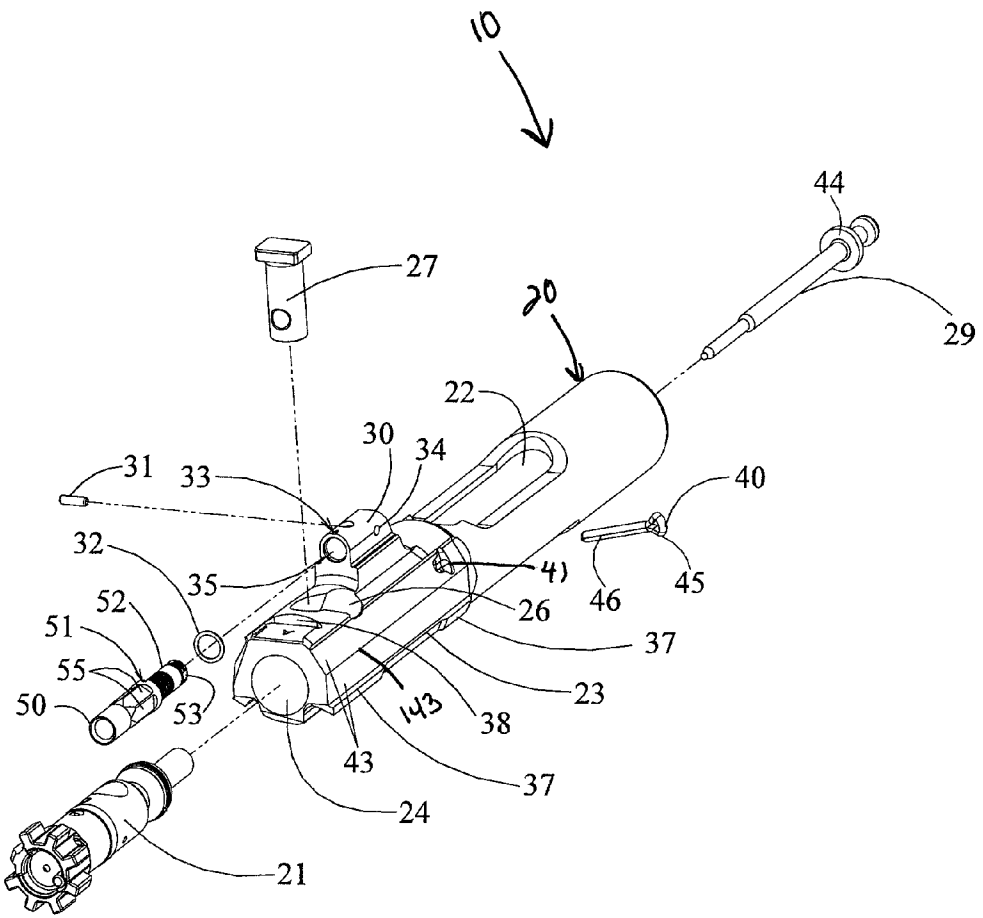
FIG. 1 is an exploded perspective view of a bolt carrier assembly including a bolt carrier, an extension nozzle, and a bolt in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The present invention is directed towards a bolt and bolt carrier group or bolt carrier assembly for use with the M4/M16/AR15 family of firearms and their derivatives. As used herein, the phrases "bolt carrier assembly" and "bolt carrier group" are used interchangeably.

Unless otherwise specified, the various components which make up the trigger mechanism, upper receiver assembly, lower receiver assembly, buttstock assembly, bolt and bolt carrier assembly are those found on the prior art M4 and M16 family of firearms.

Figure 2:
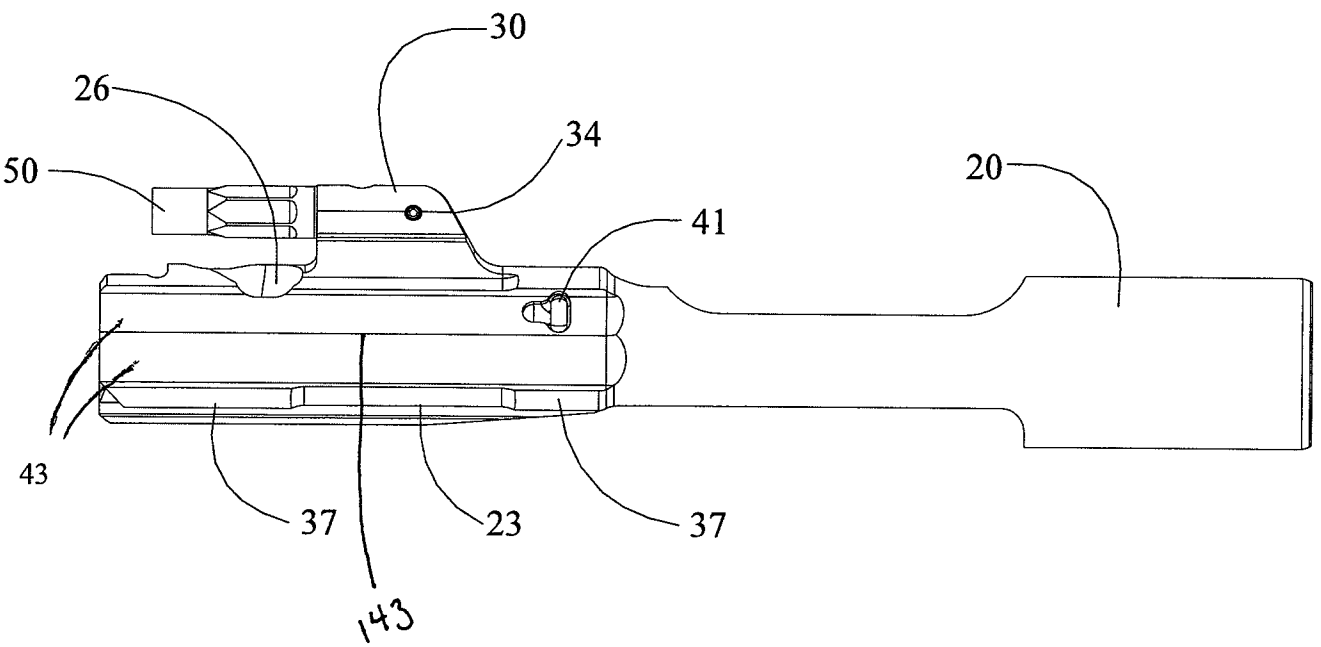
FIG. 2 is a side perspective view of the left side of the bolt carrier included in the bolt carrier assembly shown in FIG. 1.
Figure 4:
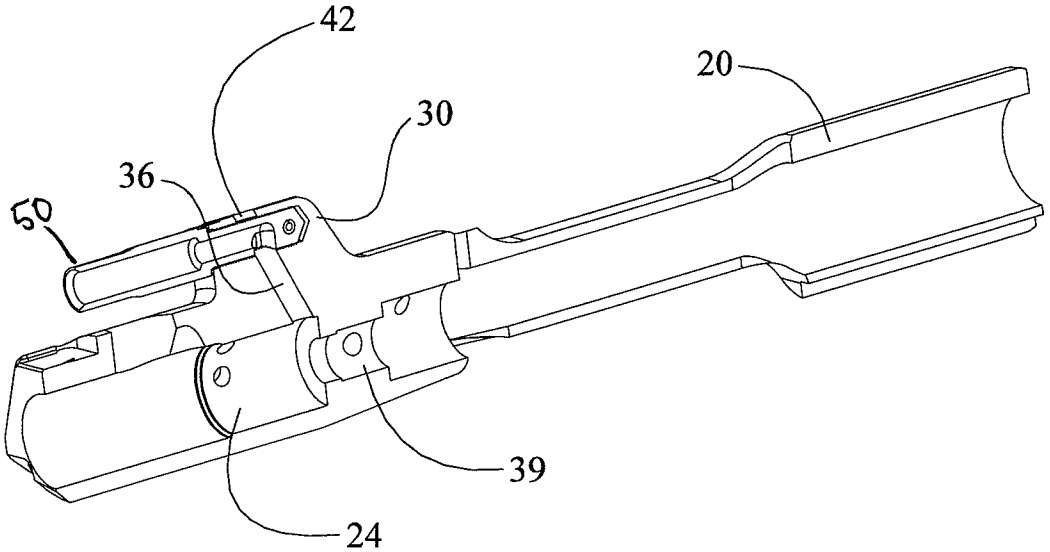
FIG. 4 is a perspective cutaway view of the bolt carrier shown in FIG. 2.

As used herein, "front" or "forward" and "distal" correspond to the end of the bolt carrier 20 where the gas key is located and nearest the muzzle of the firearm (i.e., to the left as shown in FIGS. 1, 2 and 4); and "rear", "rearward", "back" or "proximal" correspond to the end of the bolt carrier 20 nearest the buttstock of the firearm and opposite the end where the gas key is located (i.e., to the right as shown in FIGS. 1, 2 and 4).

As shown in FIG. 1, the present invention is directed to an improved bolt carrier assembly, generally designated by reference numeral 10, including a bolt carrier 20 with an integral gas key 30, a bolt 21 and an extension nozzle 50 coupled to the gas key with a roll pin 31. It will be understood that the bolt carrier assembly 10 is intended to be employed with any of the various direct gas operated M16 type firearms; however with minor modifications, some of its features could be more widely used for other firearms as well. The features of the bolt 21 are capable of being adapted to work with most direct and indirect (piston operated) gas operated firearms. It will also be understood that the bolt carrier assembly 10 is housed within an upper receiver 13, shown in FIGS. 7 and 8, of a M16 type rifle 300.

Figure 3:
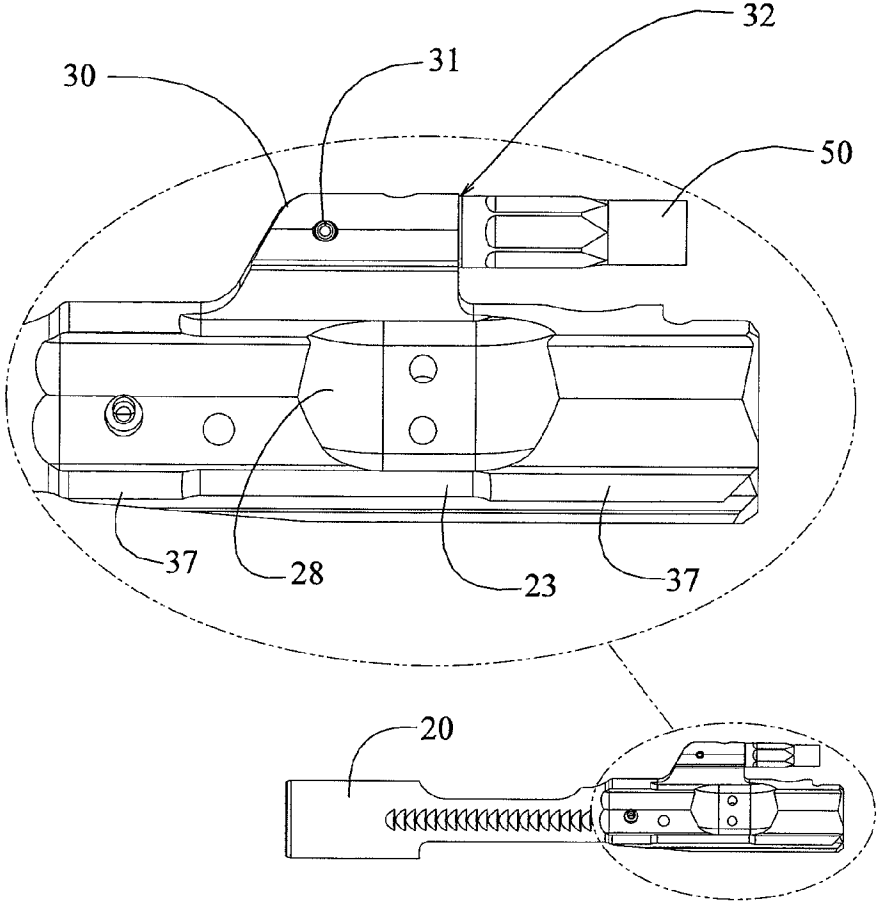
FIG. 3 is a side perspective view of the right side of the bolt carrier shown in FIG. 2.

As shown in the exploded view of the bolt carrier assembly 10 provided in FIG. 1, and the isolated views of the bolt carrier 20 shown in FIGS. 2-4, the integral gas key 30 is located on the top surface of the bolt carrier 20. The gas key 30 has an opening 34 at its rearward end for the roll pin 31, and a threaded opening 35 at its front end which interfaces with a threaded member 52 on the extension nozzle 50 as will be described more fully hereinafter. Horizontal side views of the bolt carrier 20 shown with the extension nozzle 50 threadedly retained in place and secured with the roll pin 31 are provided in FIGS. 2 and 3. The front end of the gas key 30 also has an indexing notch 33 that is used to orient the extension nozzle as will also be described more fully hereinafter.

FIG. 4 shows a cutaway view of the preferred embodiment bolt carrier 20 with the extension nozzle 50. An opening 42 is machined into the top exterior of the gas block, through to the interior opening 24 for the bolt 21. The through bore created by the machining process is generally referred to herein as a port 36. The port 36 is angled along its length and allows for the flow of expanding gases to pass from the gas key 30 into the opening 24 behind the bolt 21, thereby facilitating the operation of the rifle 300.

Figure 9:
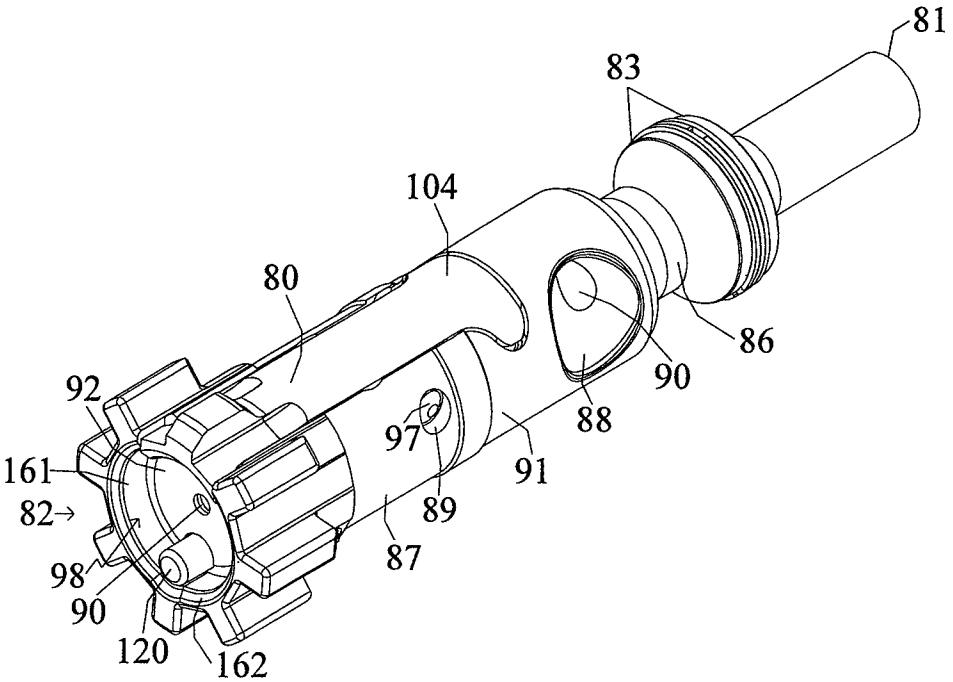
FIG. 9 is a side perspective view of the bolt included in the bolt carrier assembly shown in FIG. 1.
Figure 10:
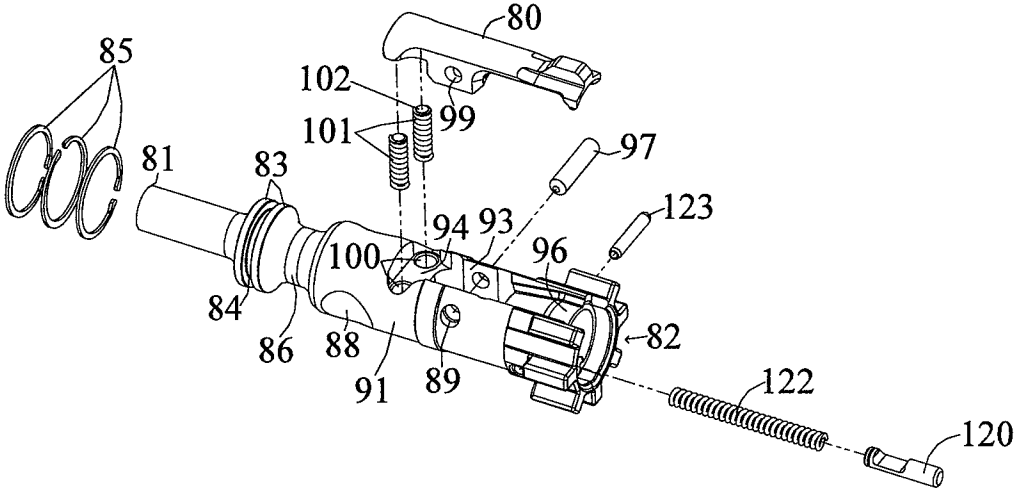
FIG. 10 is an exploded perspective view of the bolt shown in FIG. 9.
Figure 11:
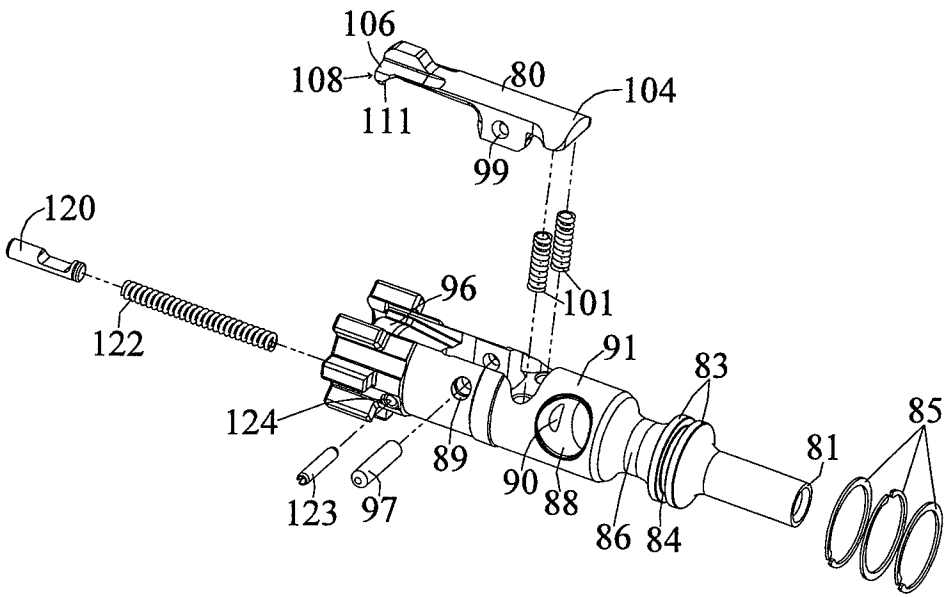
FIG. 11 is an exploded view of the bolt shown in FIG. 10 rotated 180 degrees.
Figure 12:
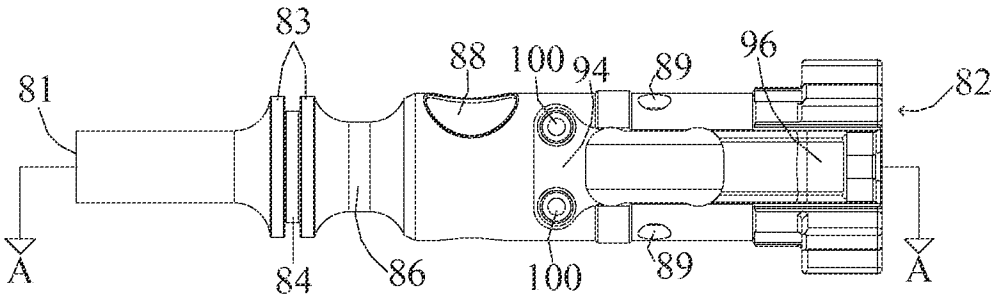
FIG. 12 is a side view of the bolt shown in FIG. 9.
Figure 13:
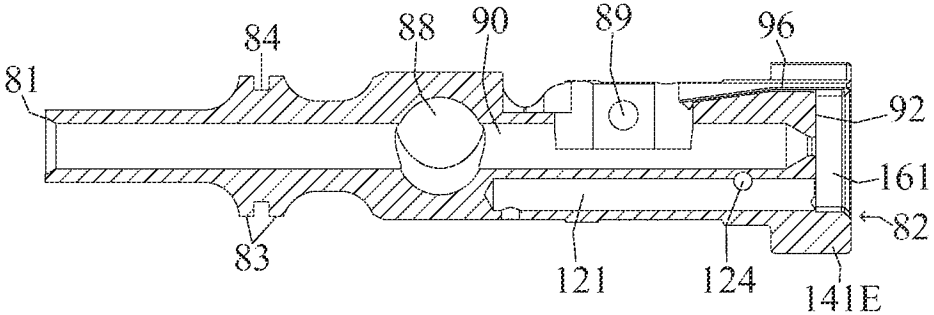
FIG. 13 is a cross sectional view of the bolt shown in FIG. 12.

Also present on the bolt carrier 20 is a hammer clearance slot 22, which permits the hammer (not shown) to extend into the bolt carrier 20 and strike a firing pin 29. An opening 41 for a cotter pin 40 and an opening 24 for a bolt 21 (shown in FIGS. 1 and 9) are also provided within the bolt carrier.

FIGS. 1 and 2 show the opening 41 designed to contain the cotter pin 40. The cotter pin 40, also referred to as a retaining pin, is installed after the firing pin 29 is placed within the interior of bolt carrier 20. The sole purpose of the cotter pin 40 is to retain the firing pin 29 within the bolt carrier 20. The opening 41 is part of a bore which runs through the bolt carrier 20, perpendicular to the longitudinal axis thereof. The bore connected to the opening 41 is constructed to accommodate the tail portion 46 of the cotter pin 40. One end of the opening 41 is constructed to hold the head 45 of the cotter pin 40 in a vertical orientation as shown in FIG. 1, thereby orienting the widest profile of the tail portion 46 towards the firing pin's 29 annular flange 44. From an external view, the opening 41 about the exterior of the bolt carrier 20 is approximately "T" shaped. As seen best in FIG. 2, the vertical portion of the opening 41 is for receiving the head 45 portion of the cotter pin 40. The horizontal portion of the opening 41 is to facilitate the insertion of a tool, such as a small screw driver, bullet tip, pliers or their equivalent, to aid in the removal of the cotter pin 40. By orienting the cotter pin 40 in this manner, the widest profile of the cotter pin 40 is oriented towards the rearward side of the annular flange 44 located near the back end of the firing pin 29. This orientation with the largest profile of the cotter pin 40 facing the annular flange 44 of the firing pin 29 makes the cotter pin 40 better able to resist metal fatigue which reveals itself as the bending or breakage of the part. It should be understood that in alternate embodiments the opening 41 could be oriented to have an external appearance such as an "X", a "+", or other equivalent shapes and structures, so long as the cotter pin 40 is being oriented to expose the largest cross section of the tail portion 46 towards the annular flange 44 of the firing pin 29 and prevent the cotter pin 40 from unnecessarily rotating.

The opening 24 in the bolt carrier 20 for the bolt 21 includes a longitudinal bore which extends from the forward end of the bolt carrier 20 rearwardly for a distance sufficient to accommodate the rearward portion of the bolt 21. A smaller bore 39 (see FIG. 4) continues for a further distance to accommodate the rear end 81 of the bolt 21. The top of the bolt carrier 20 immediately adjacent the front face thereof has a charging handle contact point 38 which facilitates manual operation of the host rifle 300.

Located rearwardly of the charging handle contact point 38 is a cam slot 26 which provides a contained area for the cam pin 27 to rotate, thus allowing the bolt 21 to move rearward and rotate axially within the bolt carrier 20. The cam pin 27 retains the bolt 21 within the bolt carrier 20.

The bolt carrier 20 is also provided with a series of bearing surfaces 37. These bearing surfaces 37 are located on the front half, top and bottom sides of the bolt carrier 20, and are in direct contact with the interior of the upper receiver 13. The bearing surfaces 37 located along the bottom portion of the bolt carrier 20 are interrupted along there length by a series of sand cuts 23. The sand cuts 23 are longitudinal cuts, having a generally rectangular shape, which reduce the exterior dimensions of the bolt carrier's bearing surfaces 37 when present. If any foreign material, including material resulting from the discharge of a firearm, accumulates within the upper receiver 13, the sand cuts 23 provide an exit for the accumulating debris.

The bolt carrier 20 is further provided with a series of flat surfaces 43 machined onto the forward portion of its exterior. These flat surfaces 43 are present on both the right and left sides of the bolt carrier 20 and machined so that they come to an apex 143. The apex 143 at which point these flat surfaces 43 meet protrudes from the exterior of the bolt carrier 20. These "flats" 43 provide additional space for the accumulation of debris. By providing space and egress points for the accumulation of debris, the static and kinetic friction forces between the bolt carrier 20 and the interior of the upper receiver 13 will not increase as rapidly during prolonged use of the host firearm. Also present is a door opener 28 which provides room for the door latch (not shown) to close.

As best shown in the isolated views in FIGS. 5A-5D, the bolt carrier assembly 10 includes an extension nozzle 50 having an indexing notch 51, a threaded member 52, an opening 53 and a port 54. Once the threaded member 52 of the extension nozzle 50 is properly threaded with the threaded opening 35 in the gas block, the roll pin 31 is inserted through the opening 34 in the gas block 30 and an opening 53 through the extension nozzle thereby rotationally restraining the extension nozzle 50. The purpose of aligning the indexing notches 51 and 33 is to ensure that the port 54 of the extension nozzle 50 is in communication with the port 36 through the gas key 30 (shown in FIG. 8) thereby facilitating the proper operation of the host firearm.

Figure 5A:
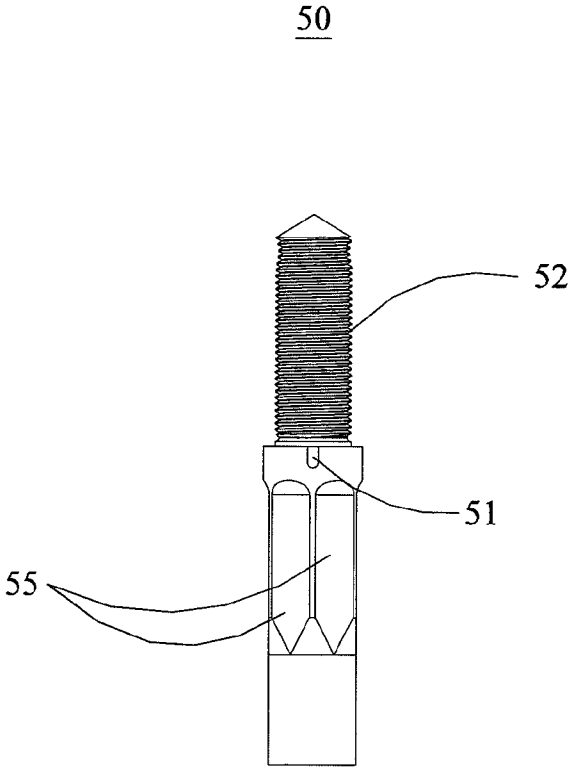
FIG. 5A is a top perspective view of the extension nozzle included in the bolt carrier assembly shown in FIG. 1.
Figure 5B:
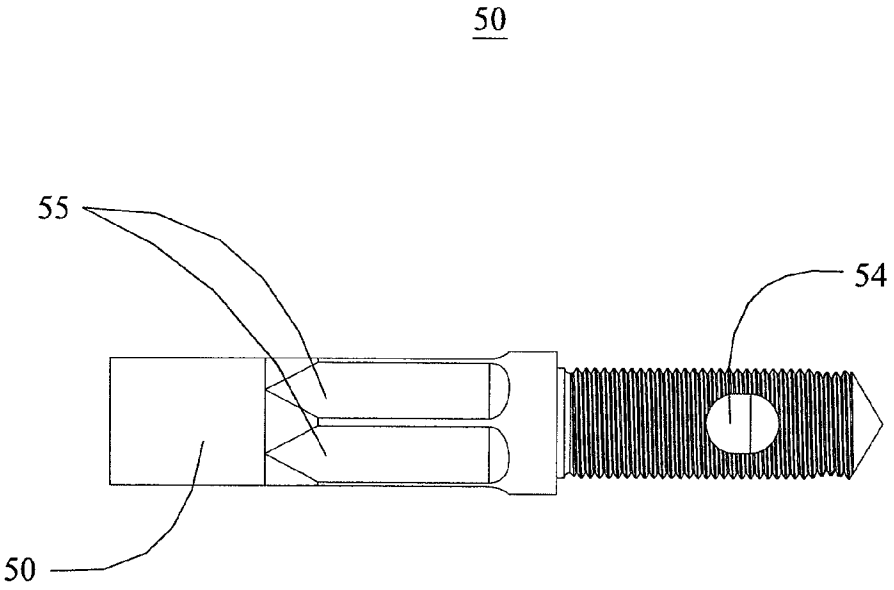
FIG. 5B is a bottom perspective view of the extension nozzle shown in FIG. 5A, with the extension nozzle rotated 180 degrees about its longitudinal axis relative to the view shown in FIG. 5A, making the gas port visible.
Figure 5C:
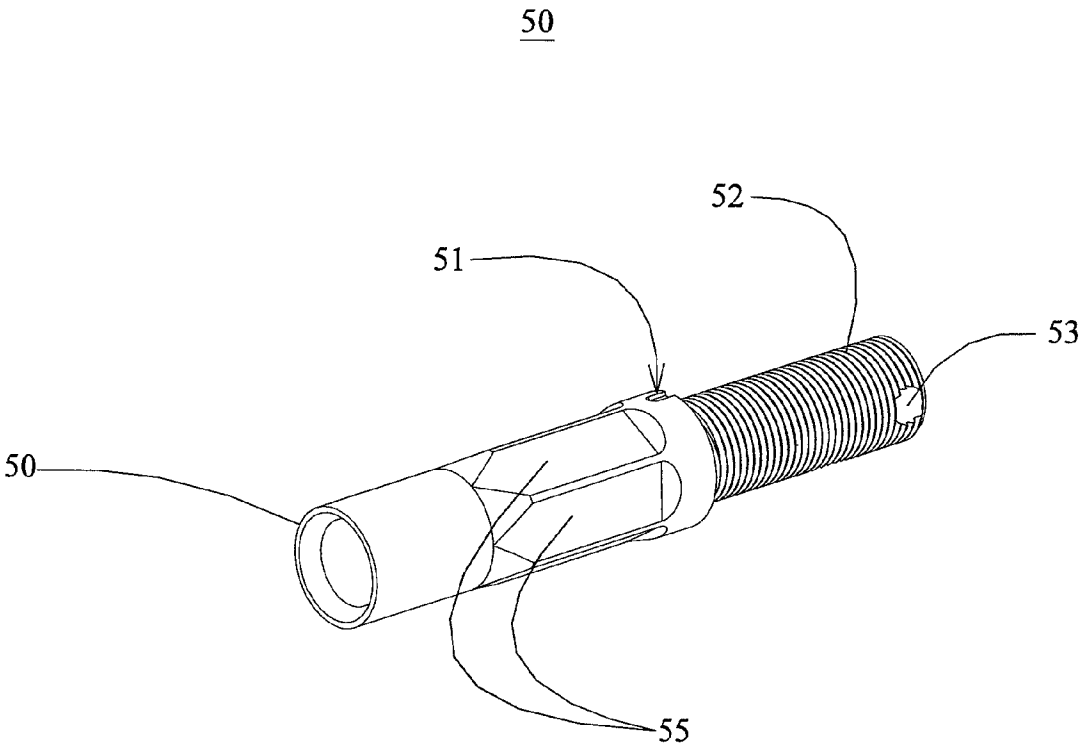
FIG. 5C is a side perspective view of the extension nozzle shown in FIG. 5A with the nozzle rotated 90 degrees from the position shown in FIG. 5B, making the opening for the roll pin visible.
Figure 5D:
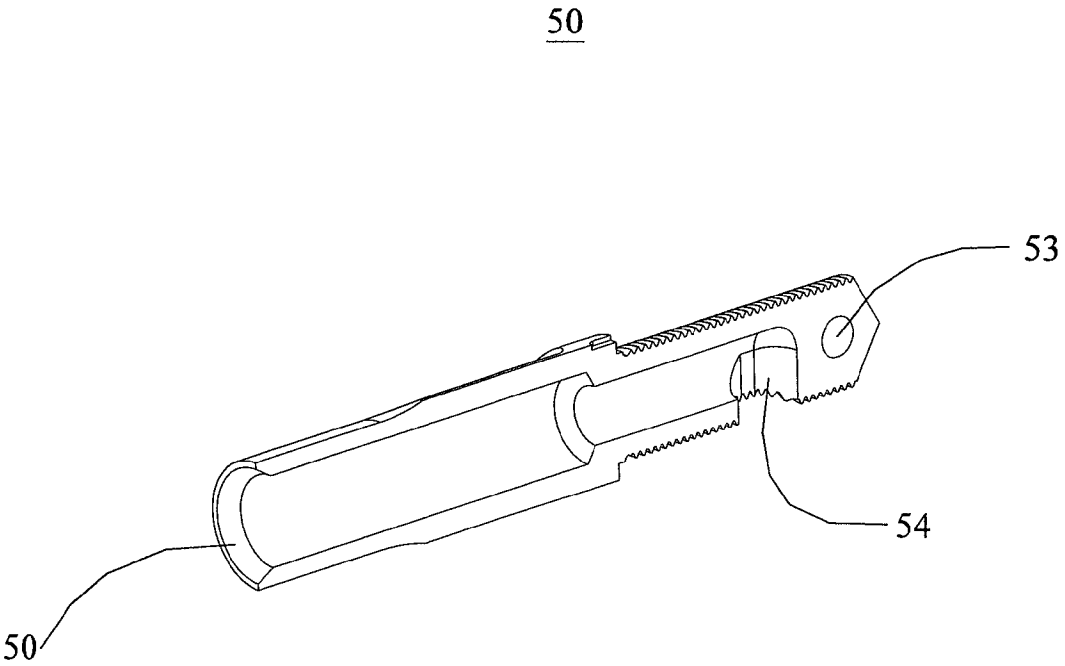
FIG. 5D is a perspective cutaway view of the extension nozzle shown in FIG. 5C, showing the opening through the extension nozzle and the gas port.

More particularly, a top perspective view of the extension nozzle is shown in FIG. 5A, with FIG. 5B being a bottom perspective view of the extension nozzle rotated 180 degrees about its longitudinal axis relative to the view shown in FIG. 5A, making the gas port 54 visible. FIG. 5C is a side perspective view of the extension nozzle rotated 90 degrees from the position shown in FIG. 5B, making the opening 53 for the roll pin 31 visible. Finally, FIG. 5D is a perspective cutaway view of the extension nozzle shown in FIG. 5C, showing the opening through the extension nozzle 50 and the gas port 54.

A timing washer 32, which is located between the extension nozzle 50 and the forward face of the gas key 30, may be placed over the threaded member 52 of the extension nozzle 50 and used as a means to orient the extension nozzle 50 when it is threadedly secured to the gas block 30. More particularly, a series of wrench flats 55 are provided about the exterior of the extension nozzle 50 and provide a means by which torque may be applied during installation of the extension nozzle 50. A crescent wrench or a wrench of similar design is used to rotate the nozzle 50 by engaging with the wrench flats 55. When the extension nozzle 50 is being threaded into the gas block 30, the indexing notch 51 of the extension nozzle 50 is aligned with the indexing notch 33 of the gas key 30. The timing washer 32, which allows for a predetermined torque value to be applied, is selected during assembly to facilitate alignment of the two separate indexing marks 33 and 51 and application of the proper torque range. The timing washer 32 is machined from stainless steel but other materials suitable for use in the manufacture of washers would also be acceptable. Alternatively, modern manufacturing techniques and technologies make it possible to time the threads, thereby eliminating the need for a timing washer 32.

Another method of securing the extension nozzle 50 to the gas block 30 includes press fitting them together. This can be achieved by manufacturing an extension nozzle 50 without a threaded member and a gas block which has a non-threaded opening. The threaded portion of the threaded member 53 shown in the illustrated embodiment would be replaced by a smooth exterior, shaped to be received by the non-threaded opening in the gas block. Such a non-threaded extension nozzle would need to be manufactured such that it required substantial force to be pressed into the opening of the gas block. Once pressed into place, the extension nozzle could then be further secured into place through the use of a roll pin such as roll pin 31 or alternatively, welded.

The roll pin 31 used to assist in securing the extension nozzle 50 to the gas key 30 may, alternatively, be replaced with a non-tensioning type (i.e. dowel pin). This solution works because the gas key 30 of the bolt carrier 20 rides in a channel 14 (shown in FIG. 7) within the interior of the upper receiver 13. The location of the gas key 30 within this channel 14 retains the dowel or roll pin because there is insufficient space between the exterior of the gas key 30 and the walls of the channel 14 for the roll pin 31 to fall out.

Figure 6:
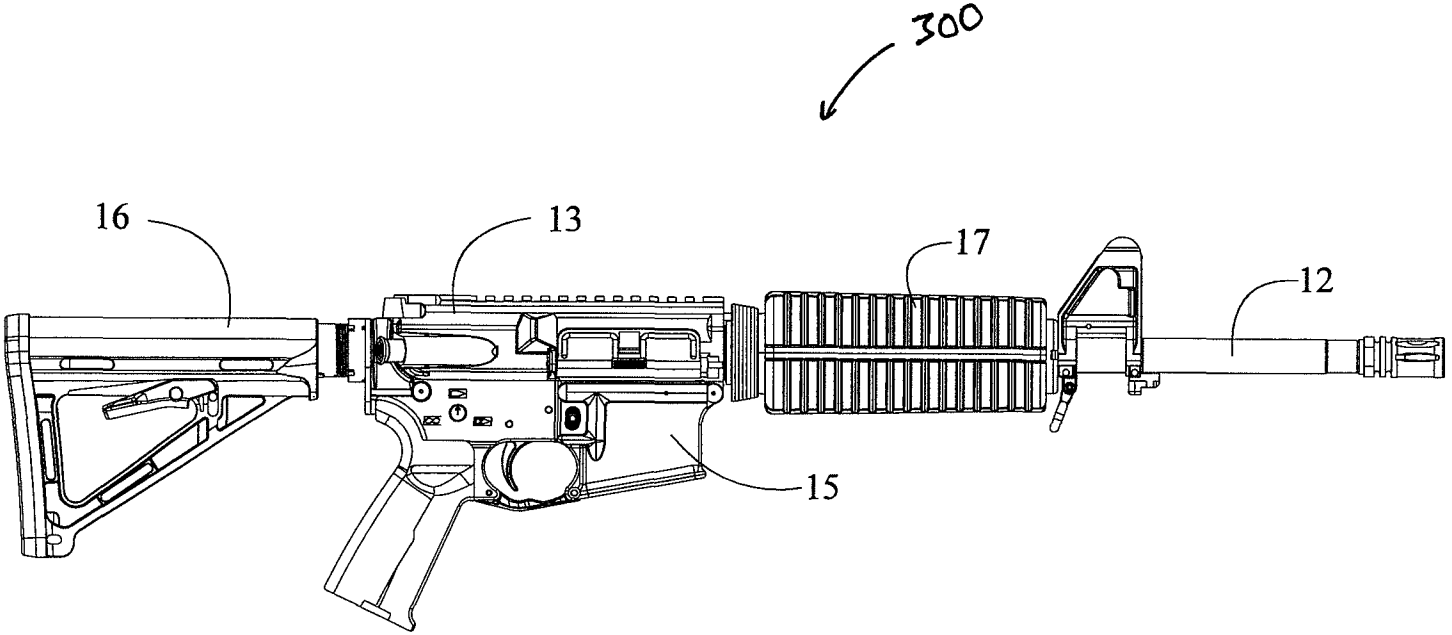
FIG. 6 is a side perspective view of the right side of an AR15/M16 type rifle which is operated by direct gas impingement and suitable for use with the bolt carrier in accordance with the present invention.

FIG. 6 illustrates a perspective side view of a direct gas operated rifle 300, generally consisting of an upper receiver group and a lower receiver group. The lower receiver group, well known in the prior art, generally consists of a lower receiver 15 with internal operation control components, a buffer tube and buttstock 16. The upper receiver group generally consists of an upper receiver 13, a barrel 12, and a set of handguards 17, all well known throughout the prior art.

Figure 7:
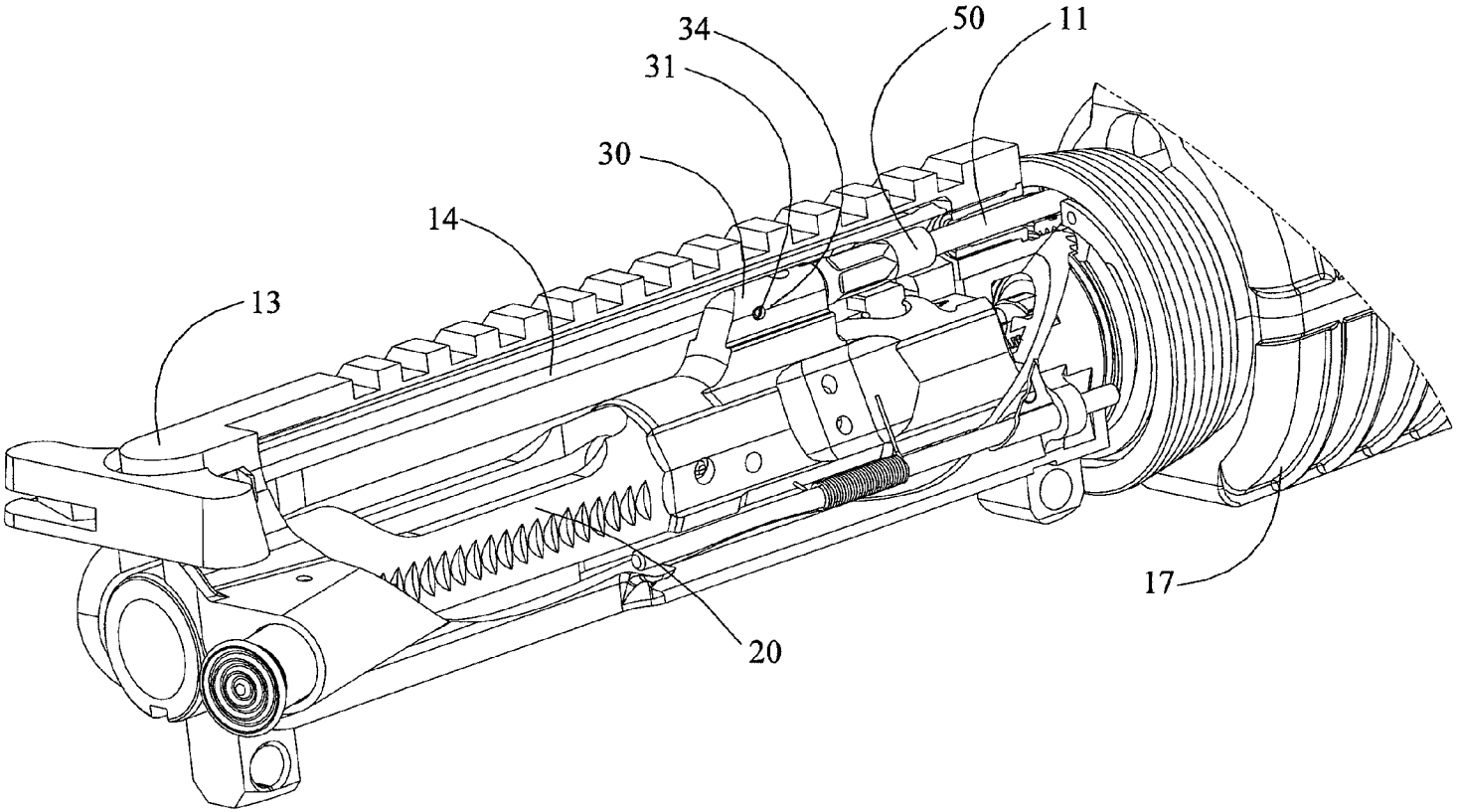
FIG. 7 is a perspective cutaway view of the upper receiver used with the AR15/M16 type rifle shown in FIG. 6.

FIG. 7 shows a side cutaway view of the upper receiver 13 in which the channel 14 in which the gas key 30 rides is visible. The channel 14 is generally rectangular in shape and constructed to allow for the longitudinal travel of the gas key 30 and other attached components. The channel 14 is narrow enough to prevent the roll pin 31 holding the extension nozzle 50 from falling out of the opening 34 which is designed to house it. Thus the channel passively assists the roll pin 31 in securing the extension nozzle 50 onto the gas key 30.

Figure 8:
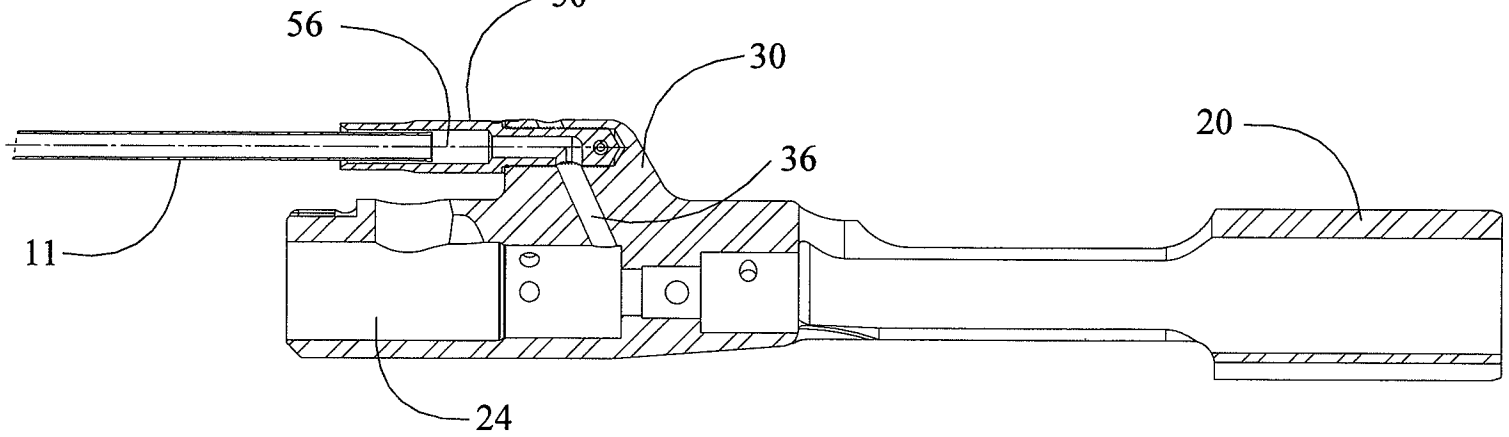
FIG. 8 is a perspective cutaway view of the bolt carrier shown in FIG. 2 along with a portion of a gas tube of the host firearm.

FIG. 8 shows a side cutaway view of the bolt carrier 20 and extension nozzle 50. This view illustrates the gas tube 11 of the host firearm being received by and in operational contact with the opening at the forward end of the extension nozzle 50. In the illustrated embodiment, the opening at the forward end of the extension nozzle 50 has been provided with a 60-degree chamfer to ease its acceptance of the gas tube 11. When the rifle 300 is discharged, gas travels through the gas tube 11 into the opening 56 of the extension nozzle 50, exiting the port 54 (see FIGS. 5B and 5D) located at the rear of the extension nozzle 50, into the port 36 which travels through the gas key 30 arriving at the rear portion of the opening 24, which houses the bolt 21, where the expansion of the gas causes the bolt carrier 20 to move rearward. After a round of ammunition has been fired the bolt carrier group 10 is only able to move rearwardly when the chamber pressure of the barrel 12 decreases sufficiently, thereby allowing the bolt 21 to rotate and disengage from the barrel extension (not shown).

The incorporation of the port 36 through the interior of the bolt carrier 20 is a significant feature related to its manufacture. The bolt carrier 20, in general, is manufactured through the use of lathes and mills to create its general shape along with both its internal and external structures. The bolt carrier may also be cast, with secondary machining operations being performed to bring critical surfaces within the required specifications. After the integral gas block 30 is machined onto the exterior of the bolt carrier 20, a drill press, mill or similar machine is used to machine the opening 42 into the top exterior of the gas block, through to the interior opening 24 for the bolt 21. As previously noted, the resulting port 36 is angled along its length. After the port 36 is drilled, the opening 35 at the forward end of the gas block 30 is threaded to receive the extension nozzle 50.

The bolt 21 of FIG. 1 is shown in greater detail in FIGS. 9-13 and 15A, 15B and 16. The bolt 21 is comprised of an elongated body having a rear end 81 and a front end 82 located along a longitudinal axis. Located about the rear end 81 of the bolt 21 are two circumferential flanges 83 which occupy parallel plains leaving a space, or groove 84, therebetween. The groove 84 is formed to accept a series of gas sealing rings 85. The bolt 21 is formed with a neck portion 86 extending between the annular flanges 83 and the cylindrical body 87. The cylindrical body 87 of the bolt defines a first bore 88 and a second bore 89, both of which extend through the cylindrical body 87 of the bolt 21. In the interior of the bolt 21, there is formed a longitudinal bore 90 which receives the firing pin 29. The cylindrical body 87 also defines an exterior surface 91 thereabout. The face portion 92 of the bolt 21 serves as a cartridge bearing surface 92 and is located near the front end 82. A separate structure but integral feature of the bolt face 92 is the circumferential groove 162 present on the exterior portion of what defines the bolt face 92 (shown in FIGS. 15A and 15B). The circumferential grove 162 is present to facilitate the accumulation of debris incidental to the firing of the associated indirect gas operated rifle 300 (see FIG. 6). In addition, the circumferential groove 162 about the bolt 21 face 92 relives material stress.

The cylindrical body 87 portion of the bolt 21 defines an extractor recess 93. The extractor recess 93, formed on the exterior surface 91, is in communication with the longitudinal bore 90, or firing pin bore. A bearing portion 94 for the extractor 80 resides within the extractor recess 93 and is integrally formed with the body 87 of the bolt 21. The extractor bearing portion 94 of the recess 93 includes a mating surface 96 (see FIG. 13) defining a curved plane substantially parallel to the exterior surface 91 of the bolt 21 such that the face 92 is circular. The underside 95 of the extractor 80 is also curved so that it may engage with and rest against the mating surface 96.

The extractor is shown in FIGS. 14A-14D. The rearward end of the extractor 80 defines a flange 104 which serves as a bearing surface for the extractor springs 101 (see FIG. 10). Located on the flange 104 are two nipples 103 each of which individually engage with a portion of an extractor spring 101.

Figure 14B:
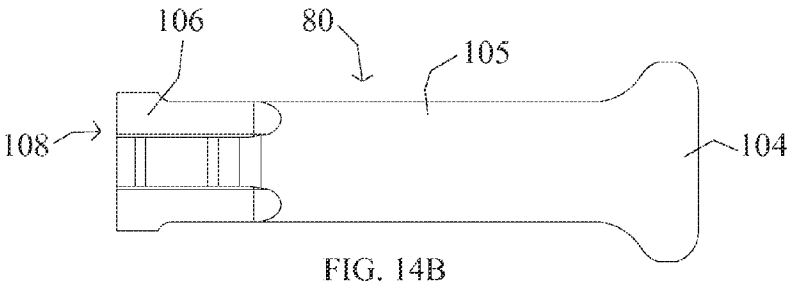
FIG. 14B shows a top perspective view of the extractor shown in FIG. 14A.
Figure 14C:
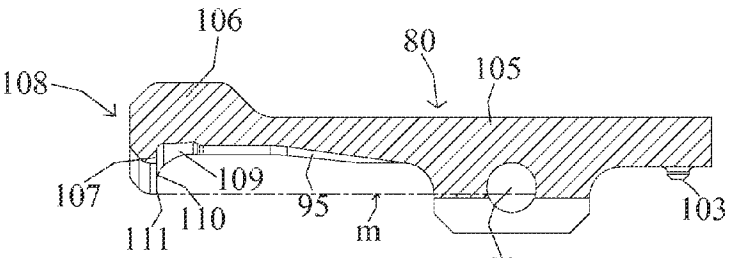
FIG. 14C shows a side cutaway view of the extractor shown in FIG. 14A.
Figure 14D:
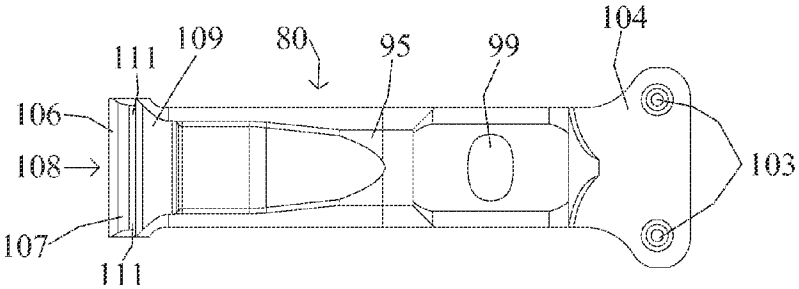
FIG. 14D shows a bottom perspective view of the extractor shown in FIG. 14B.
Figure 14A:
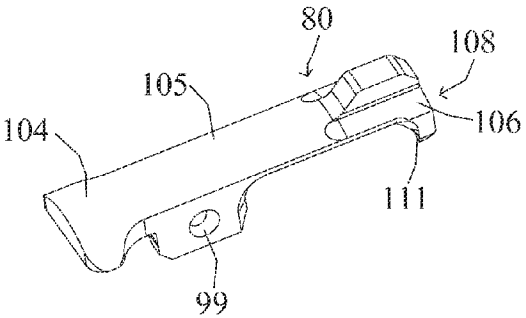
FIG. 14A shows an elevated side view of an extractor for use with the bolt carrier assembly of FIG. 1 in accordance with the present invention.

The extractor body 105 extends between the flange 104 and the extractor claw 106, located on the extractor's forward end 108. The extractor body 105 defines a pin receiving portion 99 along its length. The pin receiving portion 99 is a bore that runs perpendicular to the longitudinal axis of the extractor 80. The extractor claw 106 defines a recess 109 having an upper portion or lip 107. The lip 107 portion of the extractor claw 106 is constructed to engage with the rim of an ammunition cartridge. Structurally, the lip 107 portion of the extractor claw 106 is wider than the extractor body 105. Further, the circumferential edge 110 of the lip 107 comes to two forward edges 111 which are located on opposite sides of the extractor claw 106. The extractor 80 is symmetrical about its longitudinal axis, with FIG. 14C showing a side cutaway view of the extractor along its longitudinal axis. The two forward edges 111 occupy a plane which passes near the approximate center of the longitudinal axis (dashed lines designated by M show this relationship in FIG. 14C) of the pin receiving portion 99. The lip 107 of the extractor 80 removably retains an ammunition cartridge in place within the cartridge recess 98, against the face 92 of the bolt 21.

Prior art extractors used with U.S. military M16/M4 type rifles and their derivatives, grasp approximately 22% or less of an ammunition cartridges rim. An extractor 80 according to the present invention grasps approximately 26% or more of an ammunition cartridge rim. In the preferred embodiment of the present design, the extractor claw 106 grabs approximately 17% more of an ammunition cartridge's rim as compared to the prior art M16/M4 type extractors.

The bore of the extractor's 80 pin receiving portion 99 is configured to align with the second bore 89 of the bolt 21 when the extractor 80 is positioned within the extractor recess 93. A pivot pin 97 is extended through the second bore 89 of the bolt 21 and the pin receiving portion 99 of the extractor to pivotally engage the extractor 80 to the bolt 21. The extractor 80 and thereby its claw 106 are rotatable between a first and second position (not shown). The first position has the lip 107 engaged with the rim of an ammunition cartridge. The second position has the extractor 80 pivotally biased such that the extractor claw 106 is being forced aside during the initial seating of an ammunition cartridge.

The extractor 80 as a unit is constructed to be received within the extractor recess 92 and the extractor gap 144 located on the cylindrical body 87 portion of the bolt 21. The extractor recess 92 and extractor gap 144 are constructed to position the extractor 80 so that its forward end 108 coincides with the front end 82 of the bolt 21.

The cartridge recess 98 is laterally defined by a round side wall 161. The cartridge recess as a whole is defined by the round side wall 161 and the bolt face 92 (shown in FIGS. 9, 15A and 15B). The round side wall 161 is broken up by the extractor gap 144. An ammunition cartridge resides within the cartridge recess 98 such that the case head of the cartridge rests against the face 92 of the bolt 21.

The extractor mating surface 96 defines a portion of the circumference of the face 92 of the bolt 21. In the preferred embodiment, the circumference of the bolt 21 face 92 is circular. In the preferred embodiment of the bolt 21, the face 92 is in direct contact with the entire end portion, or case head, of a retained ammunition cartridge except for the portion which would be over the circumferential groove 162. This method of manufacturing the extractor mating surface 96 and the face 92 does not require material which supports the bolt lugs 142 to be removed thereby compromising their structural integrity.

Referring to FIGS. 10-13, the extractor recess 93 is provided with a pair of spring wells 100. The spring wells 100 are formed in the extractor recess 93 on opposite sides of the longitudinal bore 90 for the firing pin 29. The central axis of each spring well 100 is approximately parallel to the other and is perpendicular to the longitudinal axis of the bolt 21. The spring wells 100 are constructed to receive both a portion of the extractor spring 101 and the spring buffer 102. The spring buffers 102 are manufactured from high temperature resistant VITON® fluoroelastomer, but other high temperature and solvent resistant materials may be used. The buffers 102 help keep the springs 101 in linear alignment with the spring wells 100, prevent distortion of the springs 101, and assist in preventing extractor bounce.

Extractor bounce is a phenomenon whereby the extractor slips off of a seated cartridges rim when the bolt comes under a heightened recoil force generated by the host firearm's discharge, resulting in a failure to extract. When the extractor 80 is engaged to the bolt 21 as previously described above, each one of the nipples 103 on the flange 104 engages a spring 101 while it is housed in a spring well 100. In operation, the springs 101 place pressure on the flange 104 of the extractor 80, thereby pivotally biasing the extractor 80 radially inward. This allows the claw 106 of the extractor to engage the rim of an ammunition cartridge. The springs 101 used for this purpose must also have sufficient flexibility to allow the extractor 80 to pivot radially outward during the recoil cycle so that the ammunition cartridge may be ejected.

Figure 15A:
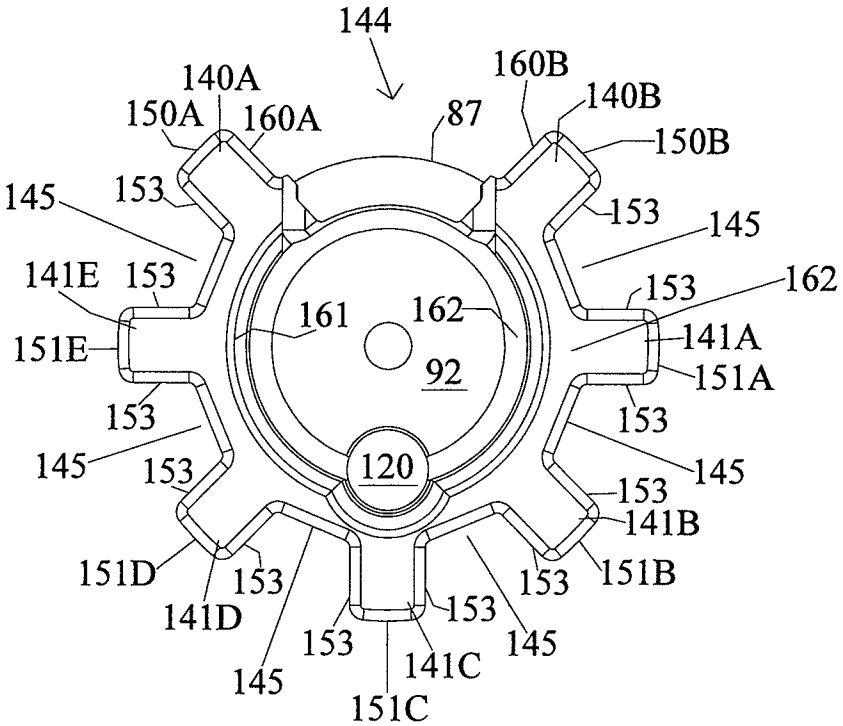
FIG. 15A is a first distal end view of the bolt shown in FIG. 9.
Figure 15B:
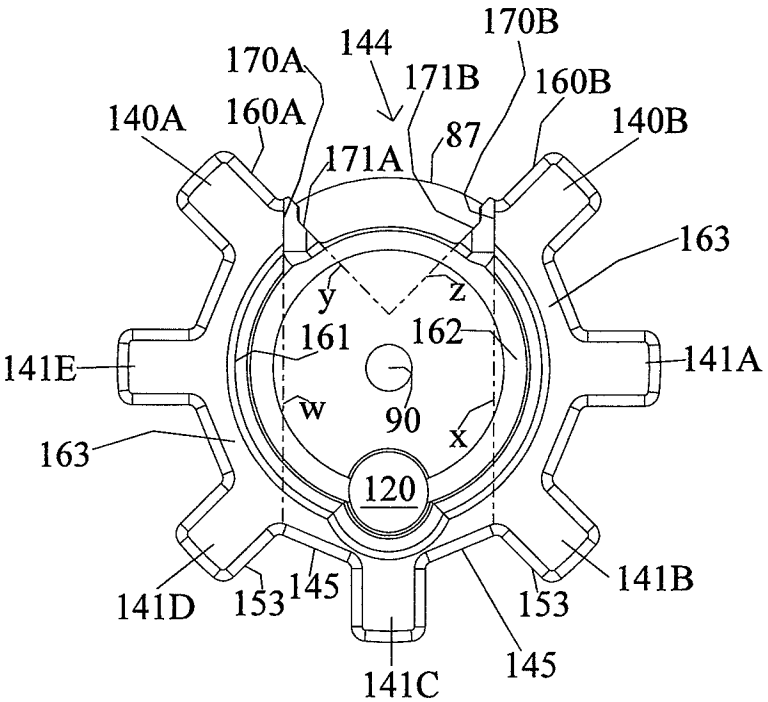
FIG. 15B is a second distal end view of the bolt shown in FIG. 15A with additional reference elements added to clarify structure.

As shown in FIGS. 15A and 15B, seven integral bolt lugs 140A, 140B, 141A, 141B, 141C, 141D, 141E (collectively referred to as "bolt lugs 142") are located adjacent to the front end 82 of the bolt 21. Each of the bolt lugs 142 is spaced evenly apart with the exception of lugs 140A and 140B. Each of the bolt lugs 142 radially extends about the longitudinal axis of the bolt 21, adjacent the front end 82. There is a gap 145 located between each pair of bolt lugs 142 with the exception of lugs 140A and 140B. Between lugs 140A and 140B there is defined a gap 144 for the extractor 80. The extractor gap 144 is configured to receive the forward end 108 of the extractor 80 to include the extractor's claw 106 portion.

Each of the bolt lugs 142 defines a corresponding end wall 150A, 150B, 151A, 151B, 151C, 151D and 151E (collectively referred to as "end walls 152") and a pair of side walls 153. At the junction where the side walls 153 meet with at least one of the end walls 152, all sharp angles have been rounded and reinforced with radii removing potential stress risers and concentrators.

In the prior art, bolt lugs 140A and 140B had a portion of the material which would have supported them removed to accommodate the extractor 80 body, a process that is referred to as undercutting the bolt. Additionally, a portion of the bolt's face was removed in order to accommodate the forward end 108 and claw 106 portions of the extractor 80. Structurally, undercutting the bolt constitutes removal of the material under the plane of sidewall 160A of lug 140A and the plane of the sidewall 160B of the lug 140B. This does not apply to the portion of the lugs 140A and 140B which protrudes above the face 92 of the bolt 21.

The preferred embodiment of the bolt 21 as described herein does not rely on removing structural material which would otherwise strengthen the bolt 21. Specifically, lugs 140A and 140B are not undercut by the extractor recess 93. Further, the portion of the extractor gap 144 which accommodates the claw 106 portion of the extractor 80 is wider than the extractor's body 105 and the extractor recess 93. The extractor recess 93 is defined as the relevant area and structural features as set forth above that are located below the horizontal plane defined by the face 92 of the bolt 21. The extractor gap 144 is defined as the relevant opening located above the plane defined by the bolt face 92 and between lugs 140A and 140B of the bolt 21 (shown in FIGS. 15A and 15B). Lug 140A may also be referred to as the first lug and lug 140B may also be referred to as the second lug.

Figure 16:
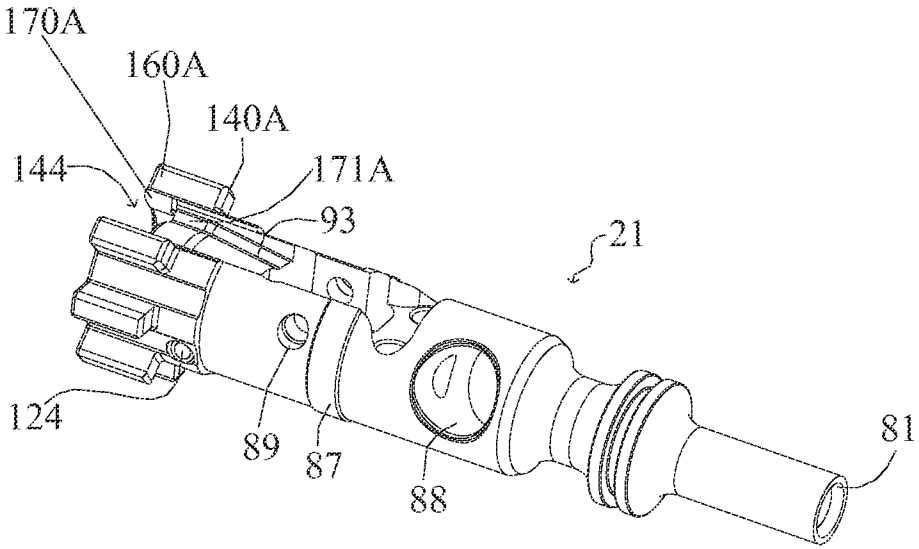
FIG. 16 is a side perspective view of the bolt shown in FIG. 9.

Best shown in FIGS. 15A, 15B and 16 are the side walls which define the extractor gap 144 and extractor recess 93 of the bolt 21. The extractor recess 93 and the extractor gap 144 interrupt the annular structure 163 about the front end 82 of the bolt 21 from which the lugs 142 radially extend. This annular structure 163 is defined as the material between the gaps 145 of the lugs 142 and the round side wall 161 of the cartridge recess 98. At one end, the annular structure 163 terminates into two side walls 170A and 171A. Side wall 170A is adjacent the extractor gap 144 while side wall 171A is adjacent the extractor recess 93. Side wall 170A forms one side of the extractor gap 144 while side wall 171A forms a portion of the side wall which is defined by the extractor recess 93.

At its other end, the annular structure 163 terminates into two side walls 170B and 171B. Side wall 170B is adjacent the extractor gap 144 while side wall 171B is adjacent the extractor recess 93. Side wall 170B forms one side of the extractor gap 144 while side wall 171B forms a portion of the side wall which is defined by the extractor recess 93.

The side wall 171A of the extractor recess is coplanar with the side wall 160A of the first bolt lug 140A. Both side walls 171A and 160A occupy the same plane which is indicated in FIG. 15B by dashed line Y. Side wall 171B is coplanar with the side wall 160B of the second bolt lug 140B. Both side walls 171B and 160B occupy the same plane which is indicated in FIG. 15B by dashed line Z. As shown in FIG. 15B, the planes represented by the dashed lines Y and Z intersect. Side walls 171A and 171B assist in supporting the first bolt lug 140A and the second bolt lug 140B respectively Side walls 170A and 170B occupy parallel planes. Further, side walls 170A and 170B define the width of the extractor gap 144 that is located above the face 92 of the bolt 21. The extractor gap 144 is wider than the extractor recess 93 that is located below the face 92 of the bolt 21.

Side wall 170A lies on a plane which is indicated in FIG. 15B by dashed line W. Side wall 170B lies on a plane which is indicated in FIG. 15B by dashed line X. Neither plane represented by X or W intersects with the other at any point. Further, the plane denoted by X intersects at the approximate junction of side wall 153 of bolt lug 141B and the portion of the annular structure 163 adjacent thereto. The plane defined by W intersects at the approximate junction between the side wall 153 of bolt lug 141D and the portion of the annular structure 163 adjacent thereto.

The bolt 21 of the present invention is turned, machined and precision ground from 9310 steel-alloy bar stock. The bolt 21 is then carburized for case hardness and tempered to increase core toughness. The bolt 21 is steel shot-peened by blasting selected surfaces with steel pellets to induce compressive stresses and improve fatigue life. A coating of nickel with TEFLON®, polytetrafluoroethylene a fluoropolymer, is applied to the bolt 21 to reduce the friction coefficient between the bolt 21 and the bolt carrier 20, and the bolt 21 and the barrel extension (not shown) of the barrel 12.

The bolt carrier 20 is machined from an 8620 steel alloy and carburized or case hardened for wear resistance. A coating comprised of nickel and TEFLON®, polytetrafluoroethylene a fluoropolymer, is applied to the bolt carrier 20. Electroless Nickel provides wear resistance for the bolt carrier 20 and makes the part easier to clean as carbon and other fouling resulting from the use of the host firearm is easier to remove. The coating also provides the parts with a natural lubricity. Even with the specificity provided above, it should be understood that the entire bolt carrier 20 and bolt 21 of the present invention could be made of conventional materials, preferably hard structural material such as steel or stainless steel and coated with prior art surface finishes such as an electrochemical phosphate conversion coating.

The bolt 21 and bolt carrier 20 of the present invention may be used in conjunction with each other or independently with prior art AR15/M4 bolt carriers or bolts. The method of securing the bolt 21 to the bolt carrier 20 is substantially similar to the methods used in the prior art. Initially the springs 101 and their buffers 102 are inserted into the spring wells 100 located within the extractor recess 93 of the bolt 21. The extractor 80 is placed within the recess 93 so that the two nipples 103 located on its flange 104 are in direct contact with the springs 101. With the pin receiving portion 99 of the extractor 80 aligned with the second bore 89 of the bolt 21, a pivot pin 97 is inserted therethrough to secure the extractor 80 to the bolt 21.

The ejector 120 and spring 122 are received within a bore 121 present on the cylindrical body 87 of the bolt 21, and retained in place through the use of a roll pin 123 as is common throughout the prior art. The roll pin 123 is received in a bore 124 present near the front end 82 of the bolt 21. The gas rings 85 are flexed so that they may be received within the groove 84 present near the rear end 81 of the bolt 21. After the bolt 21 and bolt carrier 20 are assembled as described above, the bolt 21 is inserted into an opening 24 found on the carriers 20 forward end. The first bore 88 of the bolt 21 is oriented so that it aligns with the cam slot 26 of the bolt carrier 20. The cam pin 27 is then inserted through the cam slot 26 and into the first bore 88 of the bolt 21 and rotated so that an opening present along its bottom side is aligned with the bore 39 of the bolt carrier 20, the specifics of which are well known in the prior art. Next the firing pin 29 is inserted through the bore 30 of the bolt carrier 20 and into the longitudinal bore 90 of the bolt 21. The firing pin 29 is secured in placed through the use of a cotter pin 40. The cotter pin 40 is inserted into an opening 41 located on the bolt carrier's exterior and oriented within the opening 41 as described above.

Thus the assembly of the bolt 21 and bolt carrier 20 has been described. By reversing the steps detailed above the bolt carrier 20 and bolt 21 may be disassembled for maintenance and repaired as required.

In sum, the present invention provides an improved means for securing a gas nozzle to the bolt carrier of an M16 type rifle. By integrating the gas key 30 onto the bolt carrier 20, the problems associated with the prior art attachment methods are eliminated. By threadedly securing the extension nozzle 50 to the gas key 30 and retaining the extension nozzle 50 in place through the use of a roll pin 31, a superior attachment method is provided. This method of manufacturing a bolt carrier eliminates the extraction and ammunition feeding problems associated with gas leakage linked to the compromised union between the prior art gas key 61 and bolt carrier 60.

The present invention also provides an improved structure on the bolt carrier 20 which orients the cotter pin 40 in a position that optimizes its service life. The opening 41 for the cotter pin 40 holds it in a vertical orientation which places its widest profile towards the back side of the annular flange 44 of firing pin 29. The use of this feature is not limited to rifles using the direct gas operating system seen on the rifle 300 shown in FIG. 6; it is also applicable and appropriate for use with indirect gas operated rifles, commonly referred to as piston operated rifles.

Additionally, there is provided a bolt 21 which provides an extractor recess 93 which does not rely on undercutting the face 92 of the bolt 21 in order to accommodate an extractor 80. Also provided is an extractor which has been designed to grasp at least 26% of an ammunition cartridge's rim.

In an alternate embodiment the extractor flange 104 could be modified to use a prior art spring and buffer without departing from the significant advantages offered by the herein disclosed apparatus.

In still another alternate embodiment, the bolt face 92 could be machined without the inclusion of the circumferential groove 162.

In yet another alternate embodiment of the bolt, the features of the present invention have been adapted to work with ammunition types used with AR15/M16 type rifles, and their unique bolts, that are not based around the military standard 5.56×45 mm ammunition cartridge. This alternative embodiment of the bolt, generally designated by reference numeral 200, is shown in FIGS. 17-24.

The preferred embodiment of the bolt 21 shown in FIG. 1 is configured to work optimally with the ammunition casing used with 5.56×45 mm ammunition and all structural and dimensional equivalents. Examples of ammunition which use a structurally equivalent ammunition casing for the purposes of this disclosure are .223 Remington, .300 Whisper and .300 BLK, to name a few. The critical case dimension is the portion of the ammunition cartridge, or case head, which resides within the cartridge recess on the bolts front end. Ammunition cartridges which have larger case heads (also referred to as alternative cartridges herein), such as 6.8 mm SPC and 7.62×39 mm, typically require the bolt face to have a larger opening. Prior art bolt designs for the 6.8 mm SPC cartridge and other alternative cartridges, rely on removing an approximately rectangular portion of the bolts face and adjacent lugs along with a portion of the annular structure to which the bolt lugs are attached in order to accommodate the cartridges case head and the extractor (see FIG. B). Further, material is removed from the extractor claw portion, with the extractor's lip being reduced in size due to the diameter of the alternative ammunition cartridge's case head. These modifications to the extractor are required so that the extractor can accommodate the alternative cartridges case head and still allow the extractor to seat properly against the mating surface provided on the bolt.

Manufacturing a bolt for use with AR15/M4/M16 type rifles which can accommodate the cartridge case head of these alternative cartridges results in structural material located below the face of the bolt, that is located behind the bolt lugs adjacent the extractor gap to be removed, thus compromising their structural integrity. The reduction in the size of the extractor claw reduces its contact surface area, thereby reducing the extractor's ability to effectively remove spent ammunition cartridges during the firing and extraction cycle of the host firearm. Therefore there exist a need to overcome these and other deficiencies in the prior art.

Figure 17:
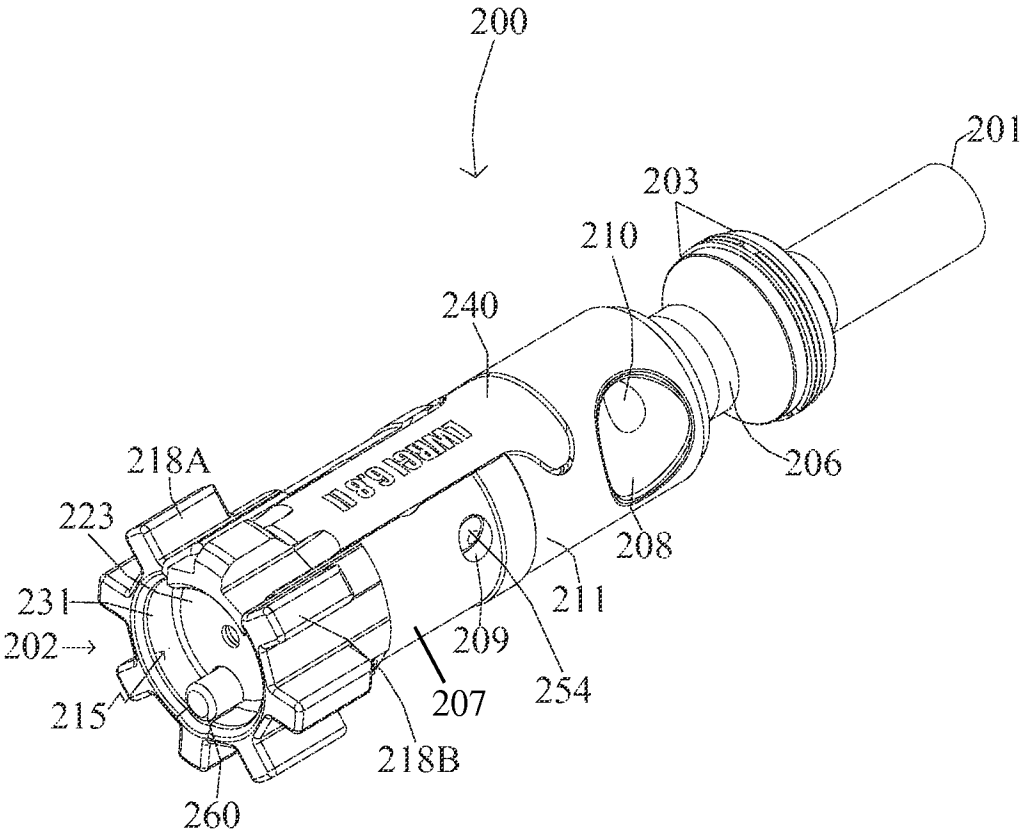
FIG. 17 is a side perspective view of an alternate embodiment bolt in accordance with the present invention.
Figure 18:
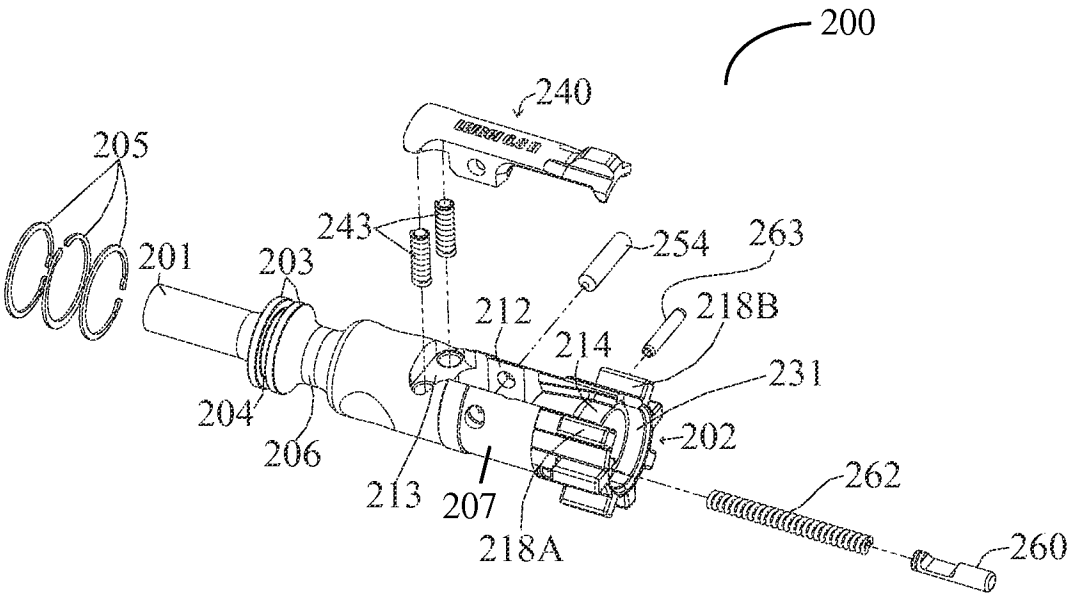
FIG. 18 is an exploded perspective view of the bolt shown in FIG. 17.
Figure 23A:
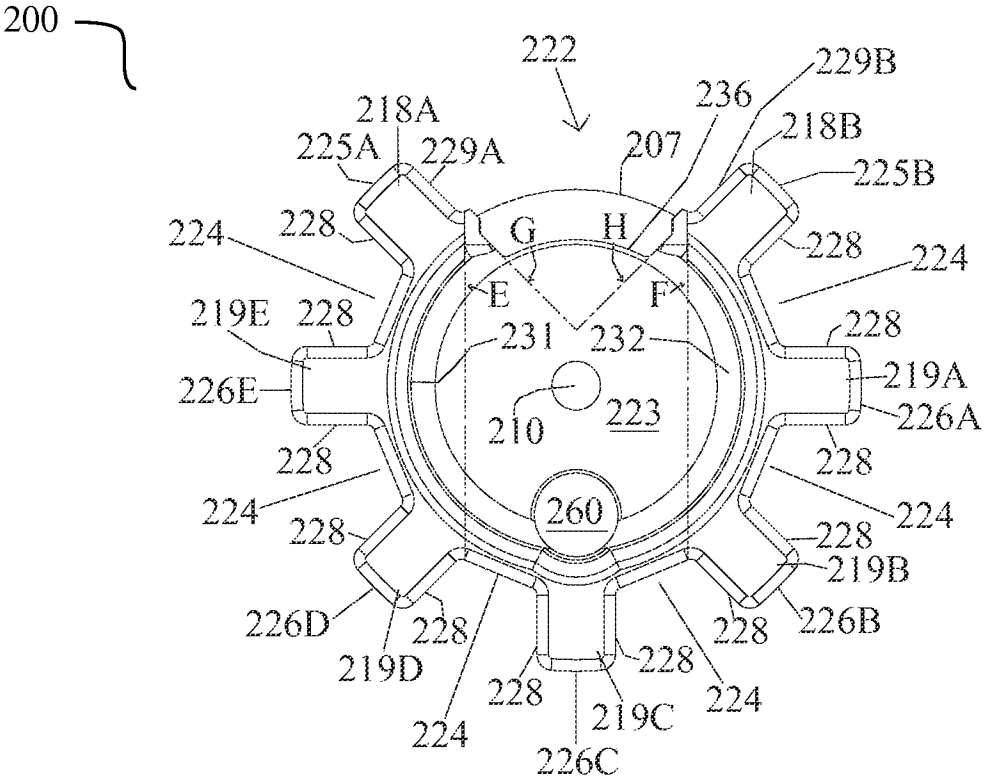
FIG. 23A is a first distal end view of the bolt shown in FIG. 17.
Figure 23B:
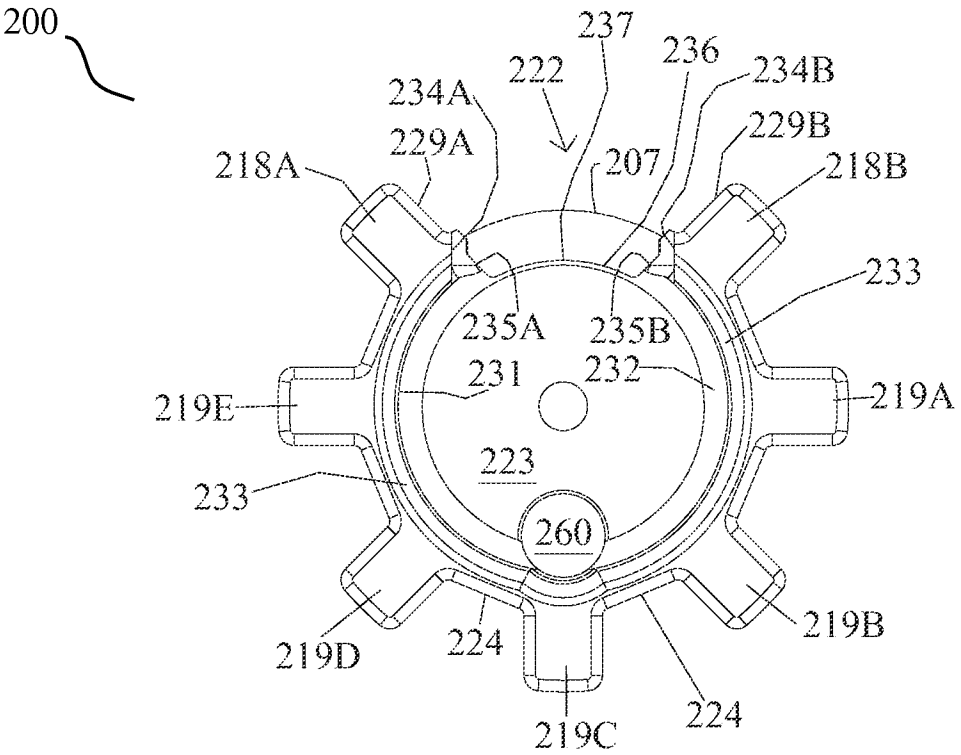
FIG. 23B is a second distal end view of the bolt shown in FIG. 23A with additional reference elements added to clarify structure.
Figure 24:
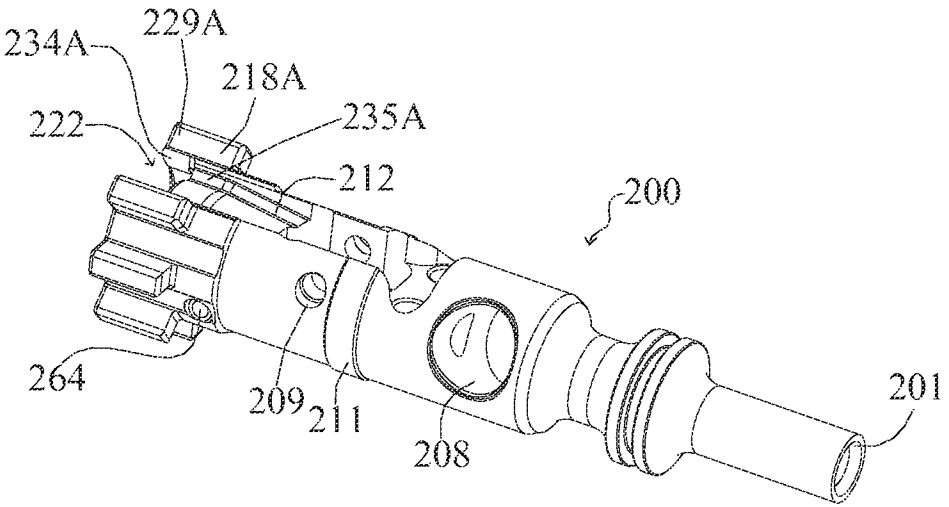
FIG. 24 is a side perspective view of the bolt shown in FIG. 17.

Except as specified herein, this alternate embodiment bolt 200 is substantially the same as the bolt 21 shown in FIG. 1. The bolt 200 is comprised of an elongated body having a rear end 201 and a front end 202 located along a longitudinal axis. Located about the rear end 201 of the bolt 200 are two circumferential flanges 203 which occupy parallel plains leaving a space, or groove 204, therebetween (FIG. 18). The groove 204 is formed to accept a series of gas sealing rings 205 (FIG. 18). The bolt 200 is formed with a neck portion 206 extending between the annular flanges 203 and the cylindrical body 207 (FIG. 18). The cylindrical body 207 of the bolt defines a first bore 208 and a second bore 209 (FIG. 17), both of which extend through the cylindrical body 207 of the bolt 200. In the interior of the bolt 200, there is formed a longitudinal bore 210 (FIG. 17) which receives a firing pin. The cylindrical body 207 also defines an exterior surface 211 thereabout. The face portion 223 of the bolt 200 serves as a cartridge bearing surface and is located near the front end 202 (FIGS. 17 and 23A-23B). A separate structure but integral feature of the face portion 223 is the circumferential groove 232 present on the exterior portion of what defines the bolt face 223 (shown in FIGS. 23A and 23B). The circumferential grove 232 is present to facilitate the accumulation of debris incidental to the firing of the associated indirect gas operated rifle 300 (see FIG. 6). In addition, the circumferential groove 232 about the bolt 200 face 223 relieves material stress. When manufacturing the bolt for use with alternative cartridges, the diameter of the bolt's face 223 is increased resulting in a portion of the bolt face 223 being removed, creating a gap 236 thereon (FIGS. 23A-23B and 24). This gap 236 is required as it provides necessary clearance for the extractor 240 disclosed herein.

Figure 20:
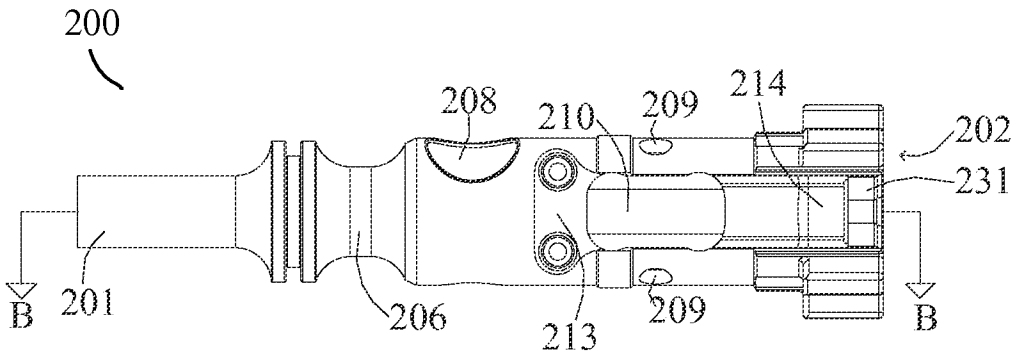
FIG. 20 is a side view of the bolt shown in FIG. 17.
Figure 21:
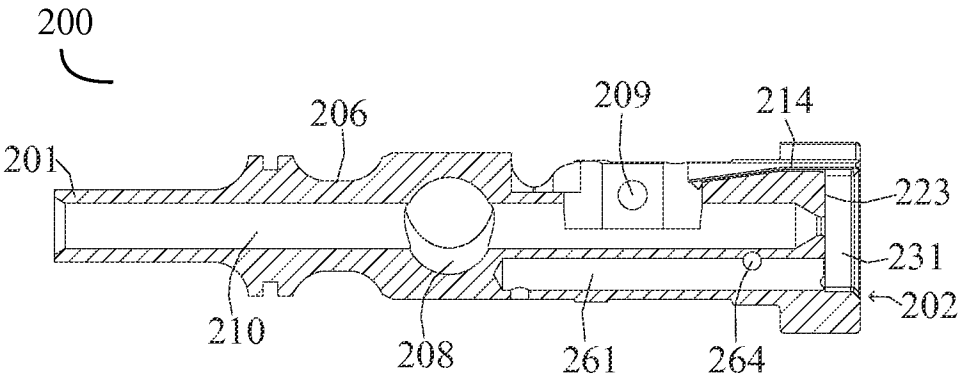
FIG. 21 is a cross sectional view of the bolt shown in FIG. 20.

The cylindrical body 207 portion of the bolt 200 defines an extractor recess 212 (FIG. 18). The extractor recess 212, formed on the exterior surface 211 (FIGS. 17 and 24), is in communication with the longitudinal bore 210 (FIG. 20), or firing pin bore. A bearing portion 213 (FIGS. 18 and 20) for the extractor 240 resides within the extractor recess 212 and is integrally formed with the body 207 of the bolt 200. The extractor recess 212 also includes a mating surface 214 (see FIGS. 18, 20 and 21) defining a curved side wall 237 (FIG. 23B) substantially parallel to the exterior surface 211 of the bolt 200 (FIGS. 18, 20 and 21). In order to form the mating surface 214 for the extractor 240, a segment of the bolt face 223 and the underlying material is removed (see FIGS. 23A and 23B), leaving a gap 236. The underside 241 (FIGS. 22C-22D) of the extractor 240 is also curved so that it may engage with and rest against the mating surface 214.

Figure 19:
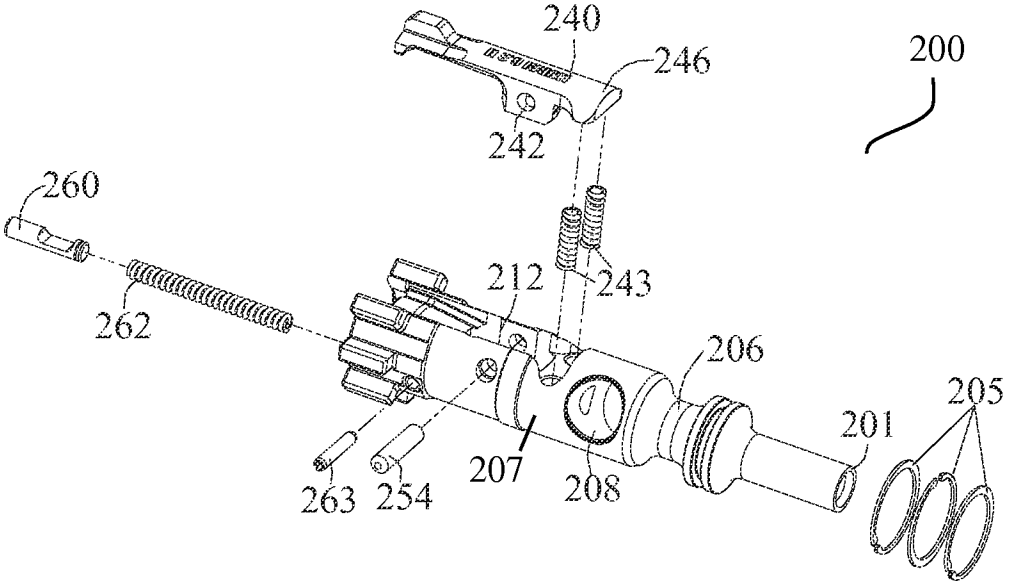
FIG. 19 is an exploded view of the bolt shown in FIG. 18 rotated 180 degrees.

The extractor is shown in FIGS. 22A-22D. The rearward end of the extractor 240 defines a flange 246 which serves as a bearing surface for the extractor springs 243 (see FIGS. 18-20). Located on the flange 246 are two nipples 245 (FIGS. 22C and 22D) each of which individually engage with a portion of an extractor spring 243 (FIGS. 18-19).

Figure 22B:
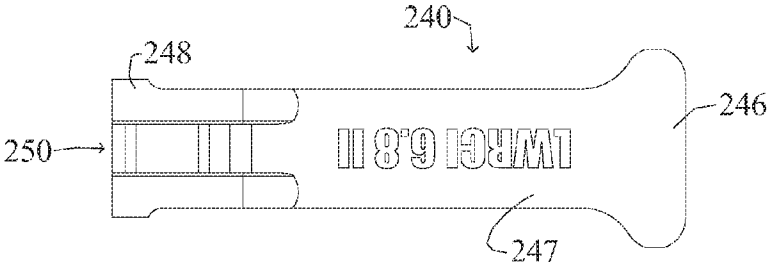
FIG. 22B shows a top perspective view of the extractor shown in FIG. 22A.
Figure 22C:
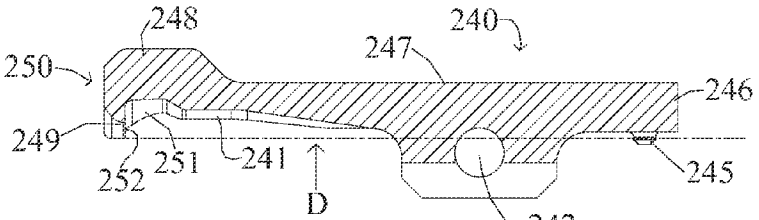
FIG. 22C shows a side cutaway view of the extractor shown in FIG. 22A.
Figure 22D:
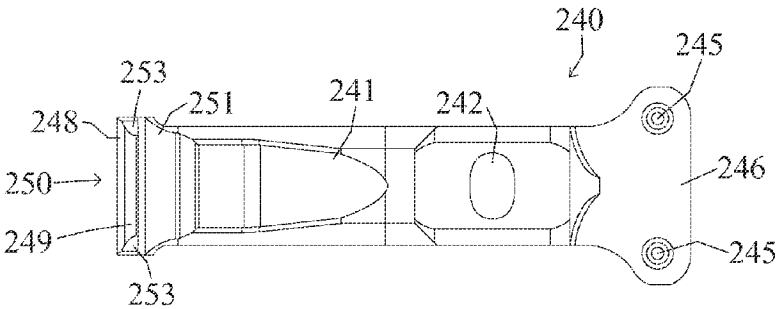
FIG. 22D shows a bottom perspective view of the extractor shown in FIG. 22B.
Figure 22A:
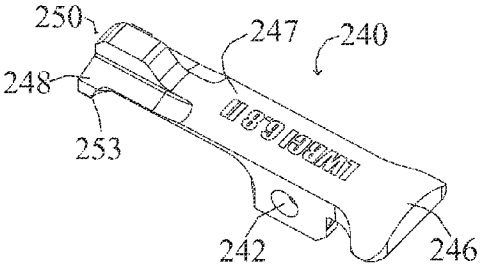
FIG. 22A shows an elevated side view of an alternate embodiment extractor for use with the bolt assembly of FIG. 17 in accordance with present invention.

The extractor body 247 extends between the flange 246 and the extractor claw 248, located on the extractor's forward end 250 (FIG. 22A). The extractor body 247 defines a pin receiving portion 242 along its length. The pin receiving portion 242 is a bore that runs perpendicular to the longitudinal axis of the extractor 240. The extractor claw 248 defines a recess 251 having an upper portion or lip 249 (FIGS. 22C-22D). The lip 249 portion of the extractor claw 248 is constructed to engage with the rim of an ammunition cartridge. Structurally, the extractor claw 248 portion of the extractor 240 is wider than the extractor body 247. Further, the circumferential edge 252 (FIG. 22C) on the interior of the lip 249 comes to two forward edges 253 (FIG. 22D) which are located on opposite sides of the extractor claw 248. The extractor 240 is symmetrical about its longitudinal axis, with FIG. 22C showing a side cutaway view of the extractor along its longitudinal axis. The two forward edges 253 occupy a plane which intersects with, and bisects, the nipple 245 located on the extractor's 240 flange 246 (dashed lines designated by "D" show this relationship in FIG. 22C). The lip 249 of the extractor 240 removably retains an ammunition cartridge in place within the cartridge recess 215 (see FIG. 17), against the face 223 of the bolt 200.

An extractor 240 according to the present alternate embodiment of the invention grasps approximately 0.0077 square inches of a 6.8 mm SPC ammunition cartridge rim which is approximately 57% more of the ammunition cartridges rim as compared to some of the prior art M16/M4 type extractors used with 6.8 mm SPC bolts.

The bore of the extractors 240 pin receiving portion 242 (FIGS. 22C-22D) is configured to align with the second bore 209 (FIG. 17) of the bolt 200 when the extractor 240 is positioned within the extractor recess 212. A pivot pin 254 (FIG. 18) is extended through the second bore 209 of the bolt 200 and the pin receiving portion 242 of the extractor to pivotally engage the extractor 240 to the bolt 200. The extractor 240 and thereby its claw 248 are rotatable between a first and second position (not shown). The first position has the lip 249 engaged with the rim of an ammunition cartridge. The second position has the extractor 240 pivotally biased such that the extractor claw 248 is being forced aside during the initial seating of an ammunition cartridge.

The extractor 240 as a unit is constructed to be received within the extractor recess 212 and the extractor gap 222 (FIGS. 23A-23B) located on the cylindrical body 207 portion of the bolt 200. The extractor recess 212 and extractor gap 222 are constructed to position the extractor 240 so that its forward end 250 coincides with the front end 202 of the bolt 200.

The cartridge recess 215 is laterally defined by an approximately round side wall 231. The cartridge recess as a whole is defined by the round side wall 231, the bolt face 223, and the gap 236 (shown in FIGS. 17, 23A and 23B). The round side wall 231 is broken up by the extractor gap 222. An ammunition cartridge resides within the cartridge recess 215 such that the case head of the cartridge rests against the face 223 of the bolt 200. The gap 236 results in a portion of the ammunition cartridges rim not being in contact with the bolt face 223.

In one embodiment of the bolt 200, the face 223 is in direct contact with the entire end portion, or case head, of a retained ammunition cartridge except for the portion that is located over the circumferential groove 232 or the gap 236 formed thereon. This method of manufacturing the extractor mating surface 214 and the face 223 does not require material which supports the bolt lugs 218A and 218B (FIGS. 17-18) to be removed, thereby compromising their structural integrity.

Referring to FIGS. 18-21 and 24, the extractor recess 212 is provided with a pair of spring wells, springs 243 and spring buffers constructed substantially the same as those disclosed in connection with the bolt 21. These components are assembled onto the bolt 200 and work in conjunction with the extractor 240 to perform the same function described in connection with the bolt 21 and extractor 80. Further, the provided combination of components (spring wells, springs and spring buffers) provide the same benefits for all disclosed embodiments of the bolt described herein where such components are incorporated. In particular, the combination of the spring wells, springs and spring buffers assist in eliminating extractor bounce, a phenomenon whereby the extractor slips off of a seated cartridges rim when the bolt comes under a heightened recoil force generated by the host firearms discharge, resulting in a failure to extract.

As shown in FIGS. 23A and 23B, seven integral bolt lugs 218A, 218B, 219A, 219B, 219C, 219D, 219E (collectively referred to as "bolt lugs 220") are located adjacent to the front end 202 of the bolt 200. Each of the bolt lugs 220 is spaced evenly apart with the exception of lugs 218A and 218B. Each of the bolt lugs 220 radially extends about the longitudinal axis of the bolt 200, adjacent the front end 202. There is a gap 224 located between each pair of bolt lugs 220 with the exception of lugs 218A and 218B. Between lugs 218A and 218B there is defined a gap 222 for the extractor 240. The extractor gap 222 is configured to receive the forward end 250 of the extractor 240 to include the extractors claw 248 portion.

Each of the bolt lugs 220 defines a corresponding end wall 225A, 225B, 226A, 226B, 226C, 226D and 226E (collectively referred to as "end walls 227") and a pair of side walls 228, except for lugs 225A and 225B. At the junction where the side walls 228 meet with at least one of the end walls 227, all sharp angles have been rounded and reinforced with radii removing potential stress risers and concentrators.

In the prior art, bolt lugs 284A and 284B have a portion of the material which would have supported them removed to accommodate the extractor body. Additionally, a portion of the bolts face is removed in order to accommodate the claw portion and a portion of the body of the extractor (see FIG. B). Removing a portion of the prior art bolt 280 face creates a gap 285 which is defined by one long straight side wall 281 with two shorter side walls, 282A and 282B. Sides walls 282A and 282B are located at opposite ends of side wall 281, both side walls 282A and 282B are at a 90 degree angle relative to side wall 281. This method of constructing the bolt 280 results in the gap 285 having generally rectangular shape and in the removal of structural material located directly behind the lugs (see FIG. B). The removal of material located behind bolt lugs 283A and 284B and below the horizontal plane defined by the bolt face, thereby creating a gap to accommodate the extractor is referred to as undercutting the bolt.

Referring back to FIGS. 23A and 23B, structurally, undercutting the bolt lugs 220 constitutes removal of material to the left of plane G of the sidewall 229A of lug 218A and to the right of plane H of the sidewall 229B of lug 218B for the purpose of including the extractor recess 212. This does not apply to the annular structure 233 located behind lugs 218A and 218B which protrudes above the face 223 of the bolt 200

The bolt 200 as described herein does not rely on removing structural material which would otherwise strengthen the bolt lugs 220 simply to accommodate the extractor 240. Specifically, lugs 218A and 218B are not undercut by the extractor recess 212 or the resulting gap 236 in the bolt face 223. Further, the portion of the extractor gap 222 which accommodates the claw 248 of the extractor 240 is wider than the extractor body 247 and the extractor recess 212. The extractor recess 212 is defined as the relevant area and structural features as set forth above that are located below the horizontal plane defined by the face 223 of the bolt 200. The extractor gap 222 is defined as the relevant opening located above the horizontal plane defined by the bolt face 223, located between lugs 218A and 218B of the bolt 200 (shown in FIGS. 23A and 23B). Lug 218A may also be referred to as the first lug and lug 218B may also be referred to as the second lug.

Best shown in FIGS. 23A, 23B and 24 are the side walls which define the extractor gap 222 and extractor recess 212 of the bolt 200. The extractor recess 212 and the extractor gap 222 interrupt the annular structure 233 (FIG. 23B) about the front end 202 of the bolt 200 from which the lugs 220 radially extend. This annular structure 233 is defined as the material between the gaps 224 of the lugs 220 and the interior side wall 231 of the cartridge recess 215, including the material of the bolt directly behind the lugs 220. At one end, the annular structure 233 terminates into two side walls 234A and 235A (FIG. 23B). The length of side wall 234A extends from the top of bolt lug 218A, adjacent the front end 202 of the bolt, to the horizontal plane defined by the bolt face 223. As a result, side wall 234A defines a portion of the extractor gap 222. Side wall 235A defines a portion of, and is adjacent to, the extractor recess 212 and the gap 236 present in the bolt face 223.

At its other end, the annular structure 233 terminates into two side walls, 234B and 235B (FIG. 23B). The length of side wall 234B extends from the top of the bolt lug 218B, adjacent the front end 202 of the bolt, to the horizontal plane defined by the bolt face 223. As a result, side wall 234B defines a portion of the extractor gap 222 in conjunction with side wall 234A. Side wall 235B defines a portion of, and is adjacent to, the extractor recess 212 and the gap 236 present in the bolt face 223. The gap 236 in the bolt face 223 is generally defined by a portion of both side wall 235A and 235B, located at opposite ends of a convex shaped side wall 237 extending therebetween (see FIG. 23B). This gap 236 is the result of the removal of a portion of the circumferential groove 232 which is part of the bolt face 223 as a whole.

The side wall 235A of the extractor recess is coplanar with the side wall 229A of the first bolt lug 218A. Both side walls 235A and 229A occupy a same plane which is indicated in FIG. 23A by dashed line G. Side wall 235B is coplanar with the side wall 229B of the second bolt lug 218B. Both side walls 229B and 235B occupy a same plane which is indicated in FIG. 23A by dashed line H. As shown in FIG. 23A the planes represented by the dashed lines G and H intersect. Side walls 235A and 235B (FIG. 23B) assist in supporting the first bolt lug 218A and the second bolt lug 218B respectively.

Side walls 234A and 234B occupy parallel planes (FIG. 23B). Further, side walls 234A and 234B define the width of the extractor gap. The extractor gap 222 is wider than the extractor recess 212 that is located below the horizontal plane defined by the face 223 of the bolt 200.

Side wall 234A lies on a plane which is indicated in FIG. 23A by dashed line E. Side wall 234B lies on a plane which is indicated in FIG. 23B by dashed line F. Neither plane represented by E or F intersects with the other at any point. Further, the plane denoted by dashed line F crosses the annular structure 233 at the junction of side wall 228 and bolt lug 219B. The plane defined by dashed lined E crosses the annular structure 233 of the bolt 200 at the junction of side wall 228 and bolt lug 219D.

The ejector 260 and spring 262 (FIGS. 18-19) are received within a bore 261 (FIG. 21) present on the cylindrical body 207 of the bolt 200, and retained in place through the use of a roll pin 263 (FIGS. 18-19) as is common throughout the prior art. The roll pin 263 is received in a bore 264 (FIG. 21) present near the front end 202 of the bolt 200. The gas rings 205 are flexed so that they may be received within the groove 204 (FIGS. 18-19) present near the rear end 201 of the bolt 200. Alternatively, the gas rings may be omitted, as appropriate, with some variants of the AR15/M16/M4 family of firearms.

The bolt 200 used with alternative cartridges, 6.8 SPC specifically for the embodiment illustrated, is manufactured in the same manner as the embodiment of the bolt 21 shown in FIG. 1. Any differences between the two bolt designs 21 and 200 are structural in nature and defined herein and/or illustrated in the associated drawings. Specifically, the manufacture of the bolt 200 to include the gap 236 is useful and required for optimal function of the bolt 200 when used with alternative cartridges, such as 6.8 mm SPC.

Bolt 200 is capable without modification of working with the bolt carrier 20 described herein or with the various other bolt carriers found in the prior art which are adaptable for use with AR15/M16/M4 type rifles, to include those which rely on either a gas tube or a gas piston.

The foregoing descriptions and drawings should be considered as illustrative only of the principles of the invention. The invention may be configured in a variety of shapes and sizes and is not limited by the dimensions of the disclosed embodiments. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A bolt for a firearm, the bolt comprising:

a generally cylindrical body having a front end and a rear end and a body portion extending therebetween, near said front end there is a mating surface located within a recess against which the base of an ammunition cartridge rests, said mating surface has a gap therein to accommodate a portion of an extractor and defines a plane which is perpendicular to the longitudinal axis of said bolt;

said body of the bolt defines an extractor recess and includes at least a first bolt lug and a second bolt lug located adjacent to said bolt's distal end, said first and second bolt lugs extending radially outwardly from the exterior of said body portion;

an extractor having a forward end, a back end and a body portion extending therebetween, said forward end having a portion being configured to engage the rim of an ammunition cartridge, said forward end of said extractor is wider than said body portion of the extractor;

said first bolt lug and said second bolt lug define a gap therebetween which is in communication with, and wider than, said extractor recess.

2. The bolt according to claim 1, wherein said gap in said mating surface defines a plurality of surfaces which form a portion of said extractor recess, said plurality of surfaces also define a bearing surface against which a portion of said extractor rest.

3. The bolt according to claim 2, wherein said gap is defined by three surfaces, one nonlinear surface and two linear surfaces, said linear surfaces are shorter in length than said nonlinear surface.

4. The bolt according to claim 3, wherein said back end of said extractor is provided two nipples which engage with two springs configured to bias said extractor into position against said bearing surface.

5. The bolt according to claim 1, wherein said forward end of said extractor consists of a claw portion configured to engage with the rim of an ammunition cartridge, said claw portion is manufactured to grasp at least 0.0077 square inches of an ammunition cartridges rim.

6. A bolt for a firearm, the bolt comprising:

an elongate body having a proximal end and an opposite distal end along a longitudinal axis and a firing pin bore along said longitudinal axis between said proximal and distal ends, said body defining a generally planar surface near the distal end which is perpendicular to the longitudinal axis of said elongate body;

an extractor having a front end and back end with a body portion extending therebetween, said front end defines a surface which is perpendicular to the longitudinal length of said body portion;

said elongate body of said bolt includes an annular structure located about said distal end where at least a first bolt lug and a second bolt lug radially extend there from, said elongate body defines an extractor recess;

said annular structure is interrupted between said first bolt lug and said second bolt lug, where said annular structure is interrupted adjacent said first bolt lug a first side wall and a second side wall are formed, where said annular structure is interrupted adjacent said second bolt lug a third side wall and a fourth side wall are formed;

said first and third side walls each extending in respective planes, positioned such that the respective planes never intersect, said first and third side walls define an opening between said first and second bolt lugs;

said second and fourth side walls each extending in respective planes, positioned such that they intersect between said gap and said firing pin bore of said cylindrical surface, said second and fourth side walls have a nonlinear side wall extending therebetween, the combination of said second, said fourth and said nonlinear side walls defines a gap in said generally planar surface.

7. The bolt of claim 6, wherein said second side wall is coplanar with a side wall of said first bolt lug and said fourth side wall is coplanar with a side wall of said second bolt lug.

8. The bolt of claim 6, wherein said second and fourth side walls define a top surface which is coplanar with the top of said generally planar surface.

9. The bolt of claim 6, wherein the opening between said first and third side walls is wider than the gap formed between said second and fourth side walls.

10. The bolt of claim 9, wherein said opening between said first and third side walls is configured to receive said front end of said extractor, said gap formed between said second and fourth side walls is configured to receive a portion of said extractor body.

11. The bolt of claim 6, wherein said perpendicular surface of said extractor front end comes to two points which are located opposite each other, said two points are coplanar and occupy a plane which intersects with a protruding structure formed on the rear end of said extractor.

12. A bolt and bolt carrier for an automatic rifle comprising:

a bolt carrier shaped as an elongated generally cylindrical body having a forward end and a rearward end as said bolt carrier is positioned in said automatic rifle;

said forward end defining an opening configured to receive the bolt; and a bolt, having a generally cylindrical body with a front end and a rear end and a body portion extending therebetween, near said front end there is a mating surface located within a recess against which the base of an ammunition cartridge rests, said mating surface has a gap therein to accommodate a portion of an extractor and defines a plane which is perpendicular to the longitudinal axis of said bolt;

said body of the bolt defines an extractor recess and includes at least a first bolt lug and a second bolt lug located adjacent to said bolt's distal end, said first and second bolt lugs extending radially outwardly from the exterior of said body portion;

an extractor having a forward end, a back end and a body portion extending therebetween, said forward end having a portion being configured to engage the rim of an ammunition cartridge, said forward end of the extractor is wider than said body portion of the extractor;

said first bolt lug and said second bolt lug define a gap which is connected with and wider than said extractor recess.

13. The bolt according to claim 12, wherein said gap in said mating surface defines a plurality of surfaces which form a portion of said extractor recess, said plurality of surfaces also define a bearing surface against which rest a portion of said extractor.

14. The bolt according to claim 13, wherein said gap is defined by three surfaces, one nonlinear surface bounded on each end by a linear surface, said linear surfaces are shorter in length than said nonlinear surface.

15. The bolt according to claim 14, wherein said back end of said extractor is provided two nipples which engage with two springs configured to bias said extractor into position against said bearing surface.

16. The bolt according to claim 12, wherein said forward end of said extractor consists of a claw portion configured to engage with the rim of an ammunition cartridge, said claw portion is manufactured to grasp approximately 0.0077 square inches of an ammunition cartridges rim.

* * * * *